US010711722B2

(12) United States Patent
Idogawa et al.

(10) Patent No.: US 10,711,722 B2
(45) Date of Patent: Jul. 14, 2020

(54) CONTROLLER OF INTERNAL COMBUSTION ENGINE AND LEARNING METHOD OF LEARNING VALUE IN INTERNAL COMBUSTION ENGINE

(71) Applicant: TOYOTA JIDOSHA KABUSHIKI KAISHA, Toyota-shi, Aichi-ken (JP)

(72) Inventors: Masanao Idogawa, Toyota (JP); Narumi Murakami, Toyota (JP); Motohiro Sugimoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 10 days.

(21) Appl. No.: 16/176,515

(22) Filed: Oct. 31, 2018

(65) Prior Publication Data

US 2019/0153972 A1 May 23, 2019

(30) Foreign Application Priority Data

Nov. 22, 2017 (JP) ..... 2017-224815

(51) Int. Cl.
*F02D 41/24* (2006.01)
*F02D 41/40* (2006.01)
(Continued)

(52) U.S. Cl.
CPC ..... *F02D 41/2454* (2013.01); *F02D 41/0032* (2013.01); *F02D 41/0042* (2013.01);
(Continued)

(58) Field of Classification Search
CPC ..... F02D 41/0032; F02D 41/0042; F02D 41/0045; F02D 41/2441; F02D 41/2454;
(Continued)

(56) References Cited

U.S. PATENT DOCUMENTS 5,529,047 A * 6/1996 Aota ..... F02D 41/004 123/674
2003/0221679 A1* 12/2003 Surnilla ..... F02D 41/0032 123/674

(Continued)

FOREIGN PATENT DOCUMENTS

JP H08-177570 A 7/1996
JP 2009-085075 A 4/2009

(Continued)

*Primary Examiner* — Hung Q Nguyen
*Assistant Examiner* — Mark L. Greene
(74) *Attorney, Agent, or Firm* — Oliff PLC

(57) ABSTRACT

A controller includes a P/L learning unit that performs P/L learning, a purge learning unit that performs purge learning, an air-fuel ratio learning unit that performs air-fuel ratio learning, and a storage unit that stores learning result. When the learning result of each learning process is not stored in the storage unit at the time of engine start, the P/L learning unit learns an injection characteristic of an in-cylinder injection valve through the P/L learning process whenever the in-cylinder injection valve performs the P/L injection and interrupts the P/L learning process before the P/L learning process is completed. The purge learning unit performs the purge learning process, and the air-fuel ratio learning unit starts the air-fuel ratio learning process provided that the P/L learning process is interrupted. The P/L learning unit then resumes the P/L learning process provided that the purge learning process is completed.

12 Claims, 9 Drawing Sheets

(51) Int. Cl.
*F02D 41/00* (2006.01)
*F02D 41/38* (2006.01)
*F02D 41/20* (2006.01)

(52) U.S. Cl.
CPC ..... *F02D 41/0045* (2013.01); *F02D 41/247* (2013.01); *F02D 41/402* (2013.01); *F02D 41/2441* (2013.01); *F02D 2041/2055* (2013.01); *F02D 2041/389* (2013.01)

(58) Field of Classification Search
CPC ..... F02D 41/247; F02D 2041/2055; F02D 41/389
See application file for complete search history.

(56) References Cited

U.S. PATENT DOCUMENTS

| | | | | |
|---|---|---|---|---|
| 2010/0235072 | A1* | 9/2010 | Okazaki | F02D 41/0042 701/106 |
| 2015/0377172 | A1 | 12/2015 | Higuchi et al. | |
| 2016/0237935 | A1 | 8/2016 | Tanaka et al. | |
| 2017/0002765 | A1 | 1/2017 | Nakano et al. | |
| 2018/0209370 | A1* | 7/2018 | Moriyama | F02D 41/266 |

FOREIGN PATENT DOCUMENTS

| | | | |
|---|---|---|---|
| JP | 2015-057552 | A | 3/2015 |
| JP | 2015-102077 | A | 6/2015 |
| JP | 2015-151871 | A | 8/2015 |
| JP | 2015-190318 | A | 11/2015 |
| JP | 2016-008569 | A | 1/2016 |
| JP | 2016-070152 | A | 5/2016 |

* cited by examiner

CONTROLLER OF INTERNAL COMBUSTION ENGINE AND LEARNING METHOD OF LEARNING VALUE IN INTERNAL COMBUSTION ENGINE

BACKGROUND OF THE INVENTION

The present invention relates to an internal combustion engine controller applied to an internal combustion engine including an in-cylinder injection valve that injects fuel into a cylinder. The present invention also relates to a learning method of a learning value in the internal combustion engine.

An internal combustion engine controller that causes an in-cylinder injection valve to perform partial lift injection terminating fuel injection before a valve body reaches a fully open position and a full lift injection to terminate fuel injection after the valve body reaches the fully open position is known in the art. In the controller described in Japanese Laid-Open Patent Publication No. 2015-190318, a learning process of the partial lift injection is performed when a predetermined learning condition is satisfied.

When the learning process of the partial lift injection is performed, a requested injection amount for an in-cylinder injection valve is divided into a set injection amount, which is an injection amount for full lift injection, and a predetermined injection amount, which is an injection amount for partial lift injection. Full lift injection is first performed to drive the in-cylinder injection valve based on the set injection amount. Then, partial lift injection is performed to drive the in-cylinder injection valve based on the predetermined injection amount. When the partial lift injection is performed in such a manner, the injection characteristic of the in-cylinder injection valve when caused to perform the partial lift injection is learned so that a deviation of a target value of a valve closing time of the in-cylinder injection valve specified from the predetermined injection amount and an actual valve closing time of the in-cylinder injection valve approaches "0" in the learning process.

The injection characteristic obtained by the learning process of the partial lift injection is stored in a storage unit of the internal combustion engine controller. However, if power is not supplied to the storage unit such as when replacing the battery, the injection characteristic will be deleted from the storage unit. Thus, if the injection characteristic is not stored in the storage unit when the engine is started, the learning process of the partial lift injection is performed during the engine operation.

In the internal combustion engine controller, an air-fuel ratio learning process of calculating a learning value of an air-fuel ratio and a purge learning process of calculating a concentration of fuel vapor purged to an intake passage when the fuel vapor is purged from a canister to the intake passage may be performed in addition to the learning process of the partial lift injection. The learning result obtained by each learning process is stored in the storage unit in the same manner as the learning process obtained by the learning process of the partial lift injection. Thus, when power is not supplied to the storage unit, the learning results obtained by the air-fuel ratio learning process and the purge learning process are also deleted from the storage unit. Therefore, if such learning results are not stored in the storage unit when the engine is started, the air-fuel ratio learning process and the purge learning process also need to be performed in addition to the learning process of the partial lift injection.

The exhaust aspect of the internal combustion engine can be stabilized by completing each learning process. Thus, when the learning result of each learning process is deleted from the storage unit, it is desired that each learning process described above be efficiently performed and completed as soon as possible.

SUMMARY OF THE INVENTION

To solve the above problem, an internal combustion engine controller is applied to an internal combustion engine including an in-cylinder injection valve that injects fuel into a cylinder. The controller includes an injection control unit that controls driving of the in-cylinder injection valve based on a requested injection amount of the in-cylinder injection valve. When partial lift injection terminating fuel injection before a valve body reaches a fully open position is performed in the in-cylinder injection valve, a partial lift learning unit performs a partial lift learning process of learning an injection characteristic of the in-cylinder injection valve so that a divergence of a correlation value of the requested injection amount and a correlation value of an actual injection amount is decreased based on the present correlation value of the requested injection amount of the in-cylinder injection valve and the correlation value of the actual injection amount of the in-cylinder injection valve when the partial lift injection is performed. The partial lift learning unit completes the partial lift learning process when the divergence is smaller than a specified value. A purge learning unit performs a purge learning process of learning a concentration of a fuel vapor purged to an intake passage when purging of the fuel vapor collected by a canister to the intake passage is permitted. An air-fuel ratio feedback unit updates a correction ratio of an air-fuel ratio to reduce a deviation of an air-fuel ratio detection value, which is a detection value of the air-fuel ratio of a mixture burned in the internal combustion engine, and a target air-fuel ratio, which is a target value of the air-fuel ratio. An air-fuel ratio learning unit performs an air-fuel ratio learning process of updating a learning value of the air-fuel ratio so that the correction ratio approaches "0". A storage unit stores a learning result of each learning process.

When the learning result of each learning process is not stored in the storage unit at the time of engine start, the partial lift learning unit learns the injection characteristic of the in-cylinder injection valve through the partial lift learning process whenever the in-cylinder injection valve performs the partial lift injection under a situation in which purging of the fuel vapor to the intake passage is stopped, interrupts the partial lift learning process before the partial lift learning process is completed, and then resumes the partial lift learning process provided that the purge learning process has been completed. When the learning result of each learning process is not stored in the storage unit at the time of engine start, the purge learning unit is configured to permit purging of the fuel vapor to the intake passage provided that the partial lift learning process is interrupted and then perform the purge learning process. When the learning result of each learning process is not stored in the storage unit at the time of engine start, the air-fuel ratio learning unit is configured to start the air-fuel ratio learning process provided that the partial lift learning process has been interrupted.

The partial lift learning process is a process of learning the injection characteristic of the in-cylinder injection valve to reduce a divergence of a request value of a fuel injection amount of the in-cylinder injection valve and an actual fuel injection amount of the in-cylinder injection valve when the partial lift injection is performed. Such a partial lift learning process is performed whenever the in-cylinder injection valve performs the partial lift injection. Since the learning of the injection characteristic of the in-cylinder injection valve by the partial lift learning process advances as the number of executions of the partial lift injection increases, the divergence gradually decreases. In other words, when the number of executions of the partial lift injection is small, it can be assumed that the learning of the injection characteristic of the in-cylinder injection valve by the partial lift learning process is not greatly advanced. When the partial lift injection is performed under a situation that the learning of the injection characteristic of the in-cylinder injection valve is not greatly advanced, the divergence tends to become large. Therefore, when the purge of the fuel vapor collected by the canister is permitted and the purge learning process is performed under the situation that the learning of the injection characteristic of the in-cylinder injection valve is not greatly advanced, the divergence is greatly reflected on the learning result of the purge learning process. As a result, the learning accuracy of the concentration of the fuel vapor by the purge learning process may become low.

In the configuration described above, when the learning result of each learning process is not stored in the storage unit at the time of engine start, purging of the fuel vapor to the intake passage is stopped, and the partial lift learning process is performed in a state where both the purge learning process and the air-fuel ratio learning process are not performed. Thus, the learning of the injection characteristic of the in-cylinder injection valve by the partial lift learning process is advanced when the purge learning process and the air-fuel ratio learning process are both not being performed. The partial lift learning process is once interrupted at a stage when the divergence of the request value of the fuel injection amount and the actual fuel injection amount during partial lift injection becomes small to a certain extent. Purging of the fuel vapor to the intake passage is then permitted, and the purge learning process and the air-fuel ratio learning process are started. In this case, since the divergence is reduced to a certain extent, the learning accuracy of the concentration of the fuel vapor by the purge learning process is less likely to lower even if the partial lift injection is performed within a period during which the purge learning process is being performed.

When the purge learning process is completed, the air-fuel ratio learning process is continued, and the partial lift learning process is resumed. In other words, the air-fuel ratio learning process is performed in parallel with the partial lift learning process. In this case, the learning of the injection characteristic of the in-cylinder injection valve by the partial lift learning process is advanced to a certain extent, and thus the update accuracy of the learning value of the air-fuel ratio by the air-fuel ratio learning process is less likely to lower even if the partial lift injection is performed while the air-fuel ratio learning process is being performed to perform the partial lift learning process. Furthermore, the air-fuel ratio learning process can be completed early compared to when performing the air-fuel ratio learning process after the partial lift learning process is completed.

Therefore, according to the configuration described above, each learning process can be completed early by efficiently performing each learning process.

Since the learning of the injection characteristic of the in-cylinder injection valve by the partial lift learning process advances as the number of executions of the partial lift injection increases, the divergence of the request value of the fuel injection amount and the actual fuel injection amount during partial lift injection gradually decreases. Therefore, when the number of executions of the partial lift injection reaches the specified number of times, determination can be made that the divergence is reduced by the partial lift learning process.

Thus, when stopping the purging of the fuel vapor to the intake passage and then performing the partial lift learning process, the partial lift learning unit is configured to interrupt the partial lift learning process provided that the partial lift injection has been executed a specified number of times.

For example, the injection control unit is configured to divide a fuel injection of the in-cylinder injection valve into a plurality of times including the partial lift injection provided that an engine operation is being performed in a specified load region. Preferably, in this case, the internal combustion engine controller includes a load region setting unit configured to set a lower limit of the specified load region that increases as a temperature of a distal end portion of the in-cylinder injection valve increases before the purge learning process is completed.

The lowering amount of the temperature of the distal end portion of the in-cylinder injection valve that occurs by injecting the fuel from the in-cylinder injection valve tends to become larger as the fuel injection amount of the in-cylinder injection valve increases. Furthermore, the deposit easily accumulates at the distal end portion as the temperature of the distal end portion of the in-cylinder injection valve is higher. Thus, when the temperature of the distal end portion is high, it is not desirable to perform the partial lift injection of small fuel injection amount. In this respect, according to the configuration described above, the lower limit of the specified load region becomes greater when the temperature of the distal end portion of the in-cylinder injection valve is high compared to when the temperature of the distal end portion is low, and hence the partial lift injection of small fuel injection amount is less likely to be performed. Thus, a deposit can be restrained from easily accumulating at the distal end portion of the in-cylinder injection valve.

The internal combustion engine controller may include a requested injection amount calculating unit. When the fuel injection of the in-cylinder injection valve is divided into a plurality of times, the requested injection amount calculating unit calculates a requested injection amount of each divided fuel injection based on a basic injection amount, which is a calculation value of a fuel injection amount based on an engine load rate and the correction ratio calculated by the air-fuel ratio feedback unit. The requested injection amount calculating unit calculates the requested injection amount of each fuel injection so that when the correction ratio is a negative value, the requested injection amount of each fuel injection decreases as an absolute value of the correction ratio increases. Preferably, the injection control unit controls the driving of the in-cylinder injection valve based on the calculation result by the requested injection amount calculating unit. The load region setting unit increases the lower limit of the specified load region as the absolute value of the correction ratio increases when the correction ratio is a negative value.

When dividing the fuel injection of the in-cylinder injection valve into a plurality of times, the requested injection amount of each fuel injection is set to a value reflecting a basic injection amount and a correction ratio. Thus, when each divided injection includes the partial lift injection, the requested injection amount with respect to the partial lift injection tends to become small when the correction ratio is a negative value.

In the partial lift injection, variation easily occurs in the actual fuel injection amount as the requested injection amount is smaller. Thus, when the correction ratio is a negative value and the absolute value of the correction ratio is large, the requested injection amount with respect to the partial lift injection becomes too small and the variation in the actual fuel injection amount during the partial lift injection tends to become large. Thus, when the variation in the actual fuel injection amount is large, the learning accuracy of the injection characteristic of the in-cylinder injection valve by the partial lift learning process may lower.

In this respect, in the configuration described above, the lower limit of the specified load region is made greater as the absolute value of the correction ratio increases when the correction ratio is a negative value. Thus, when the engine operation is performed in the specified load region and the partial lift injection is performed, the fuel injection amount can be restrained from becoming too small. As a result, as the variation in the actual fuel injection amount by the partial lift injection can be suppressed, the lowering of the learning accuracy of the injection characteristic of the in-cylinder injection valve by the partial lift learning process can be suppressed.

When the partial lift injection is performed while performing the air-fuel ratio learning process, the divergence of the request value of the fuel injection amount and the actual fuel injection amount during the partial lift injection is sometimes reflected on the learning value of the air-fuel ratio updated by the air-fuel ratio learning process. Furthermore, in the partial lift injection under a situation of low engine load rate, variation easily occurs in the actual fuel injection amount as the requested injection amount of the in-cylinder injection valve is small. In other words, in the partial lift injection under the situation of low engine load rate, there is a possibility that the divergence becomes large. When the divergence is large, the update accuracy of the learning value of the air-fuel ratio by the air-fuel ratio learning process may lower. Thus, in the internal combustion engine controller, the load region setting unit increases the lower limit of the specified load region when resuming the partial lift learning from the lower limit before interrupting the partial lift learning process.

According to the configuration described above, when the air-fuel ratio learning process is performed, the execution frequency of the partial lift injection of relatively small fuel injection amount can be lowered. Thus, the update accuracy of the learning value of the air-fuel ratio by the air-fuel ratio learning process can be restrained from becoming low.

When the purge learning process is completed, the partial lift learning process is resumed. The injection characteristic of the in-cylinder injection valve is then learned through the partial lift learning process. In other words, the learning of the injection characteristic of the in-cylinder injection valve advances whenever the partial lift injection is performed. Thus, after the purge learning process is completed, the divergence of the request value of the fuel injection amount and the actual fuel injection amount during partial lift injection decreases as the number of executions of the partial lift injection increases. Furthermore, the air-fuel ratio learning process is continued even after the purge learning process is completed. The update accuracy of the learning value of the air-fuel ratio by the air-fuel ratio learning process becomes higher as the divergence is smaller.

Preferably, in the internal combustion engine, the load region setting unit decreases the lower limit of the specified load region as the number of times the partial lift injection is executed increases after the purge learning process is completed. According to such configuration, the lower limit of the specified load region decreases as determination can be made that the update accuracy of the learning value of the air-fuel ratio is higher as the number of executions of the partial lift injection increases. As a result, the execution frequency of the partial lift injection becomes high, and thus the partial lift learning process can be completed early.

Further, the load region setting unit may decrease the lower limit of the specified load region as the number of times the partial lift injection is executed increases after the purge learning process is completed. According to such configuration, the upper limit of the specified load region becomes greater because determination can be made that the update accuracy of the learning value of the air-fuel ratio is higher as the number of executions of the partial lift injection increases. As a result, the execution frequency of the partial lift injection becomes high, and thus the partial lift learning process can be completed early.

When the partial lift learning process is not yet completed, the divergence of the request value of the fuel injection amount and the actual fuel injection amount during partial lift injection tends to become larger than when the partial lift learning process is completed, and thus the update accuracy of the learning value of the air-fuel ratio by the air-fuel ratio learning process tends to be lower. Further, the air-fuel ratio learning unit may update a learning value of the air-fuel ratio so that the learning value gradually changes in the air-fuel ratio learning process. Thus, preferably, the air-fuel ratio learning unit reduces an updating speed of the learning value of the air-fuel ratio when the partial lift learning process is not completed from that when the partial lift learning process is completed in the air-fuel ratio learning process.

According to the configuration described above, when the partial lift learning process is not completed, the updating speed of the learning value of the air-fuel ratio decreases after the partial lift learning process is completed. Thus, the lowering of the update accuracy of the learning value of the air-fuel ratio by the air-fuel ratio learning process can be suppressed.

The internal combustion engine controller may further include a partial lift diagnosis unit that performs a diagnosis process of determining whether or not the partial lift injection is normally performed provided that the partial lift learning process is completed. In this case, after the partial lift learning process is completed, a diagnosis is performed to check whether or not a state in which the divergence of the request value of the fuel injection amount and the actual fuel injection amount during the partial lift injection is small, that is, to check whether or not the partial lift learning process has been normally completed. In the diagnosis process, the diagnosis described above is merely performed, and thus the execution frequency of the partial lift injection does not need to be high.

Even in a state that the partial lift learning process is completed, the divergence of the request value of the fuel injection amount and the actual fuel injection amount during the partial lift injection tends to become larger than the divergence of the request value of the fuel injection amount and the actual fuel injection amount during the full lift injection. The full lift injection is the injection of terminating the fuel injection after the valve body reaches the fully open position. Thus, even after the partial lift learning process is completed, the update accuracy of the learning value of the air-fuel ratio when the partial lift injection is performed tends to be lower than the update accuracy of the learning value of the air-fuel ratio when the partial lift injection is not performed.

Preferably, the load region setting unit narrows the specified load region as the number of times the partial lift injection is executed increases when the diagnosis process is being performed. According to such configuration, when the diagnosis process is performed after the partial lift learning process is completed, the specified load region gradually becomes narrower. In other words, the execution frequency of the partial lift injection can be gradually lowered. Thus, the partial lift injection is less likely to be performed while performing the air-fuel ratio learning process, and hence the lowering of the update accuracy of the learning value of the air-fuel ratio can be suppressed.

The energizing time of an electromagnetic coil of the in-cylinder injection valve during the full lift injection is longer than the energizing time of the electromagnetic coil during the partial lift injection. The remaining magnetism of the electromagnetic coil after the current flow is terminated tends to become larger as the energizing time of the electromagnetic coil is longer. Such remaining magnetism is gradually reduced with elapse of time. Furthermore, when the next fuel injection, that is, the next current flow to the electromagnetic coil is started with large remaining magnetism, the controllability of the in-cylinder injection valve tends to lower by the influence of the remaining magnetism. Thus, if the partial lift injection is performed after the full lift injection when dividing the fuel injection of the in-cylinder injection valve to a plurality of times, the time from the termination of the full lift injection to the start of the partial lift injection is short and the remaining magnetism of the electromagnetic coil is large, and thus the fuel injection amount during the partial lift injection tends to easily vary. As a result, the learning accuracy of the injection characteristic of the in-cylinder injection valve through the partial lift learning process tends to lower.

Preferably, when dividing a fuel injection of the in-cylinder injection valve into a plurality of times to include both a full lift injection for terminating the fuel injection after the valve body reaches a fully open position and the partial lift injection, the injection control unit has the in-cylinder injection valve perform the partial lift injection and then perform the full lift injection. According to such configuration, the partial lift injection, in which the energizing time of the electromagnetic coil is short, is performed before the full lift injection, in which the energizing time of the electromagnetic coil is long. Thus, the partial lift injection can be performed hardly without being subjected to the influence of the remaining magnetism of the electromagnetic coil. As a result, the lowering of the learning accuracy of the injection characteristic of the in-cylinder injection valve through the partial lift learning process can be suppressed.

A learning method of a learning value that solves the above problem is applied to an internal combustion engine including an in-cylinder injection valve that injects fuel into a cylinder. The in-cylinder injection valve is configured to perform partial lift injection terminating fuel injection before a valve body reaches a fully open position. The learning method updates a correction ratio of an air-fuel ratio to reduce a deviation of an air-fuel ratio detection value, which is a detection value of an air-fuel ratio of a mixture burned in the internal combustion engine, and a target air-fuel ratio, which is a target value of the air-fuel ratio. Further, the method includes performing a partial lift learning process of learning an injection characteristic of the in-cylinder injection valve when the in-cylinder injection valve performs the partial lift injection, performing a purge learning process of learning a concentration of fuel vapor purged to an intake passage when purging of the fuel vapor collected by a canister to the intake passage is permitted, performing an air-fuel ratio learning process of updating a learning value of the air-fuel ratio so that the correction ratio approaches "0", and storing a learning result of each learning process in a storage unit of the controller. In the partial lift learning process, the injection characteristic of the in-cylinder injection valve is learned so that a divergence of a correlation value of a requested injection amount and a correlation value of an actual injection amount is decreased based on the correlation value of the requested injection amount of the in-cylinder injection valve when the partial lift injection is performed and the correlation value of the actual injection amount of the in-cylinder injection valve when the partial lift injection is performed. The partial lift learning process is completed when the divergence is less than a specified determined value.

When the learning result of each learning process is not stored in the storage unit at time of engine start, the learning method further stops purging the fuel vapor to the intake passage and then performs the partial lift injection and learns the injection characteristic of the in-cylinder injection valve through the partial lift learning process whenever the partial lift injection is performed. The learning method also interrupts the partial lift learning process before the partial lift learning process is completed and then permits purging of the fuel vapor to the intake passage and performs the purge learning process while starting the air-fuel ratio learning process. Further, the learning method resumes the partial lift learning process while continuing the air-fuel ratio learning process after the purge learning process is completed. With this configuration, the same advantages as the internal combustion engine controller are obtained.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF PREFERRED EMBODIMENTS

Hereinafter, one embodiment of an internal combustion engine controller and a learning method of a learning value in the internal combustion engine will be described according to FIGS. 1 to 10.

Figure 1:
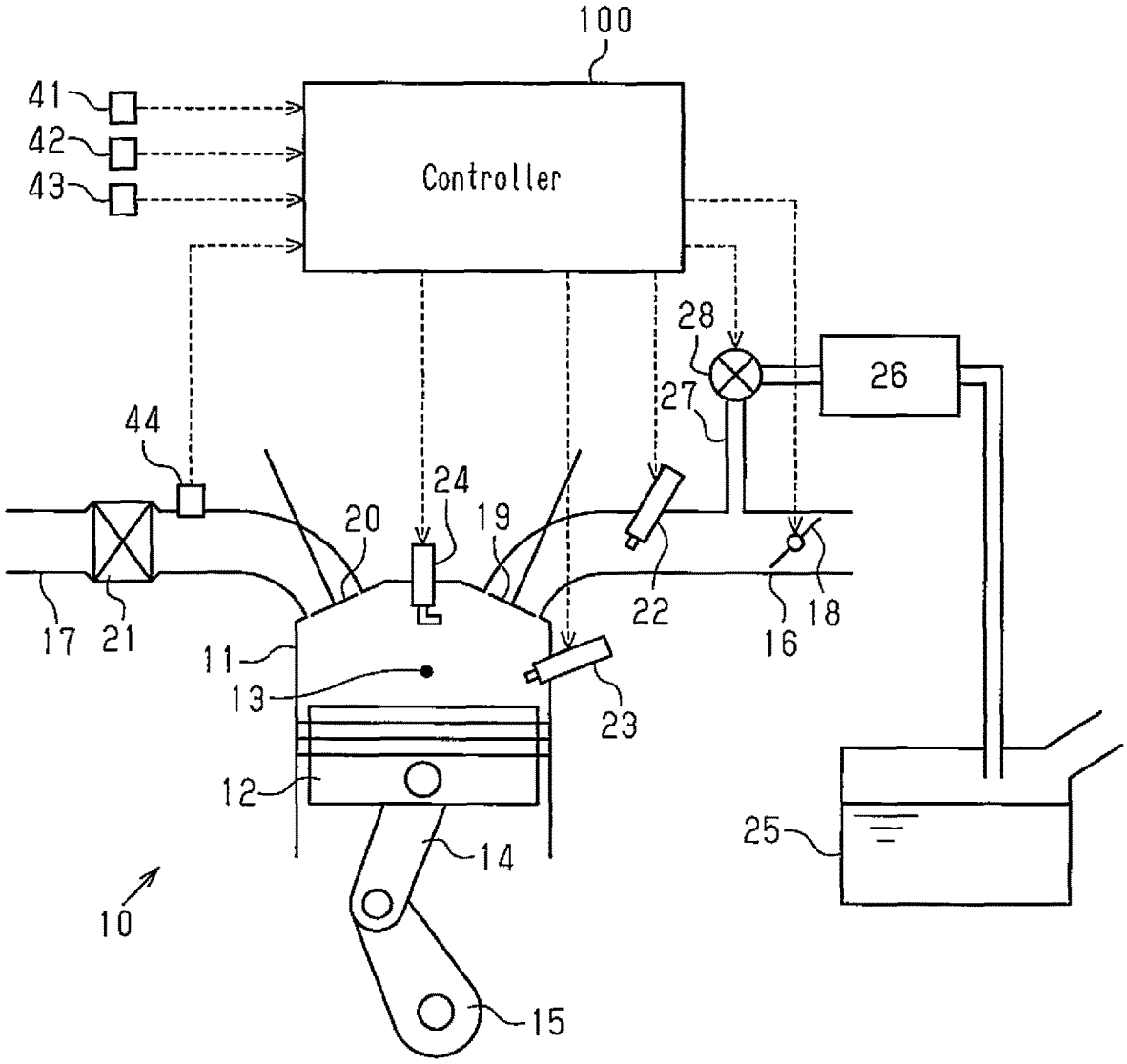
FIG. 1 is a schematic diagram of an internal combustion engine to which one embodiment of an internal combustion engine controller is applied.

FIG. 1 shows an internal combustion engine 10 to which a controller 100 of the present embodiment is applied. As shown in FIG. 1, the internal combustion engine 10 includes a plurality of cylinders 11 (only one is shown in FIG. 1), where a region above a piston 12 in each cylinder 11 is a combustion chamber 13 where mixture including fuel is burned. Each piston 12 is coupled to a crankshaft 15 by way of a connecting rod 14. An intake passage 16 and an exhaust passage 17 are connected to each combustion chamber 13. An electronic control type throttle valve 18 is provided on the intake passage 16. The opening and closing of the intake passage 16 with respect to the combustion chamber 13 are performed by an intake valve 19. A catalyst 21 having the exhaust air as a purifying target is provided on the exhaust passage 17. The opening and closing of the exhaust passage 17 with respect to the combustion chamber 13 are performed by an exhaust valve 20.

Furthermore, the internal combustion engine 10 includes a passage injection valve 22 that injects fuel toward an intake downstream side of a throttle valve 18 in the intake passage 16, and an in-cylinder injection valve 23 that directly injects fuel into the cylinder 11, namely, the combustion chamber 13. In the combustion chamber 13, the mixture including the fuel injected from at least one injection valve of the injection valves 22, 23 and the incoming air introduced from the intake passage 16 to the combustion chamber 13 is burned through spark discharge by an ignition plug 24. The exhaust air generated by the combustion of the mixture is discharged from the combustion chamber 13 to the exhaust passage 17.

Moreover, the internal combustion engine 10 includes a fuel tank 25 that stores the fuel to supply to each injection valve 22, 23, and a canister 26 that collects the fuel vapor, which is fuel vaporized in the fuel tank 25. The canister 26 communicates with the intake passage 16 through a purge passage 27. An electronic control type purge valve 28 is provided on the purge passage 27. When the purge valve 28 is closed, the purge of the fuel vapor from the canister 26 to the intake passage 16 is prohibited. When the purge valve 28 is opened, the purge of the fuel vapor from the canister 26 to the intake passage 16 is permitted. When the purge valve 28 is opened and the fuel vapor is purged from the canister 26 to the intake passage 16, the purge amount of the fuel vapor becomes greater as the opening of the purge valve 28 is larger.

As shown in FIG. 1, detection signals from various types of sensors such as an accelerator opening sensor 41, a crank angle sensor 42, an air flowmeter 43, an air-fuel ratio sensor 44, and the like are input to the controller 100. The accelerator opening sensor 41 detects an operation amount of an accelerator pedal by a driver. The crank angle sensor 42 detects an engine rotation speed Ne, which is a rotation speed of the crankshaft 15. The air flowmeter 43 detects an incoming air amount Ga introduced to the combustion chamber 13 through the intake passage 16. The air-fuel ratio sensor 44 is arranged on the exhaust upstream side of the catalyst 21 in the exhaust passage 17, and outputs a signal corresponding to an oxygen concentration of the exhaust air flowing through the exhaust passage 17. In the controller 100, an air-fuel ratio detection value Af, which is a detection value of the air-fuel ratio, is calculated based on the detection signal from the air-fuel ratio sensor 44. The controller 100 controls the throttle valve 18, the passage injection valve 22, the in-cylinder injection valve 23, the ignition plug 24, the purge valve 28, and the like based on the information obtained by various types of sensors, that is, the operation amount of the accelerator pedal, the engine rotation speed Ne, the incoming air amount Ga, the air-fuel ratio detection value Af, and the like.

The in-cylinder injection valve 23 will now be described with reference to FIGS. 2 and 3.

Figure 2:
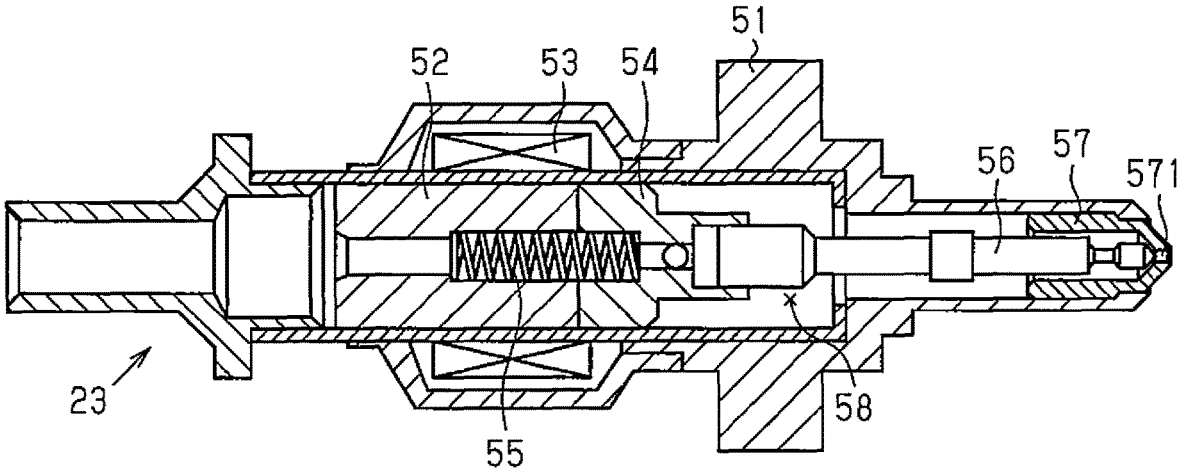
FIG. 2 is a schematic cross-sectional view showing the construction of an in-cylinder injection valve of FIG. 1.
Figure 3:
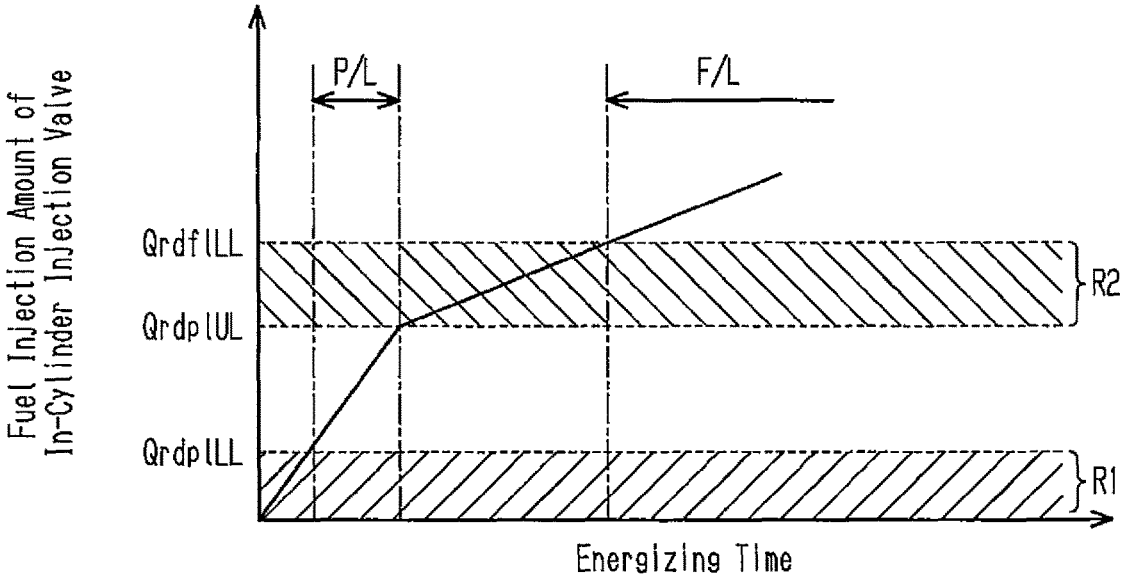
FIG. 3 is a graph showing the relationship of an energizing time and a fuel injection amount of the in-cylinder injection valve.

As shown in FIG. 2, the in-cylinder injection valve 23 includes a tubular housing 51. A fixed core 52 fixed to the housing 51, an electromagnetic coil 53 arranged at a periphery of the fixed core 52, and a movable core 54 arranged on a distal end side (right side in the figure) of the fixed core 52 are provided inside the housing 51. The movable core 54 can move forward and backward in an axial direction (left and right direction in the figure) of the housing 51. Furthermore, a spring 55 that biases the movable core 54 in a direction (right direction in the figure) of separating away from the fixed core 52 is provided on an inner side of the housing 51.

A needle valve 56 serving as a valve body is fixed to a distal end side of the movable core 54. Furthermore, a nozzle body 57 surrounding the periphery of a distal end portion of the needle valve 56 is provided at a distal end side in the interior of the housing 51, and an injection hole 571 that causes the interior and the exterior of the housing 51 to communicate with each other is formed at the distal end of the nozzle body 57.

When current is not flowing through the electromagnetic coil 53, the distal end of the needle valve 56 is seated on the nozzle body 57 by the biasing force of the spring 55. Thus, the injection hole 571 of the nozzle body 57 is closed by the needle valve 56. As a result, the fuel supplied to the combustion chamber 58 formed on the inner side of the housing 51 does not flow out to the exterior of the housing 51 through the injection hole 571, that is, the fuel is not injected from the in-cylinder injection valve 23.

When current is flowing through the electromagnetic coil 53, the movable core 54 moves closer to the fixed core 52 against the biasing force of the spring 55. As a result, the needle valve 56 is moved away from the nozzle body 57, and the fuel of the combustion chamber 58 flows out through the injection hole 571. In other words, the fuel is injected from the in-cylinder injection valve 23. When moving the movable core 54 and the needle valve 56 toward the fixed core 52 by flowing current through the electromagnetic coil 53, the movable core 54 is movable to a position at which the movable core 54 contacts the fixed core 52. In other words, the position of the needle valve 56 when the movable core 54 contacts the fixed core 52, as shown in FIG. 2, is the fully open position.

The in-cylinder injection valve 23 is configured to be able to perform the partial lift injection and the full lift injection. Hereinafter, the partial lift injection is referred to as "P/L injection" and the full lift injection is referred to as "F/L injection". The P/L injection is the injection of terminating the fuel injection, that is, terminating the current flow to the electromagnetic coil 53 before the needle valve 56 reaches the fully open position. As shown in FIG. 3, the in-cylinder injection valve 23 performs the P/L injection when a requested injection amount of the in-cylinder injection valve 23 is greater than or equal to an injection amount lower limit value QrdplLL and the requested injection amount is smaller than or equal to an injection amount upper limit value QrdplUL.

The F/L injection is the injection of terminating the fuel injection, that is, terminating the current flow to the electromagnetic coil 53 after the needle valve 56 reaches the fully open position. As shown in FIG. 3, the in-cylinder injection valve 23 performs the F/L injection when the requested injection amount of the in-cylinder injection valve 23 is greater than or equal to an injection amount lower limit valve QrdflLL.

A region R1 lower than the injection amount lower limit QrdplLL and a region R2 between the injection amount upper limit value QrdplUL and the injection amount lower limit value QrdflLL are regions where the controllability of the in-cylinder injection valve 23 lowers. Thus, when causing the in-cylinder injection valve 23 to inject fuel, the requested injection amount is calculated so that the requested injection amount of the in-cylinder injection valve 23 does not take a value in such regions R1, R2.

In the present embodiment, in the controller 100, the partial lift learning process of learning the injection characteristic is performed when causing the in-cylinder injection valve 23 to perform the P/L injection.

Hereinafter, the partial lift learning process is referred to as "P/L learning process". When causing the in-cylinder injection valve 23 to perform the P/L injection, the controller 100 drives the in-cylinder injection valve 23 based on the learning result of the P/L learning process. Furthermore, in the controller 100, the purge learning process and the air-fuel ratio learning process are also performed in addition to the P/L learning process. The purge learning process is the process of learning the concentration, that is, the purge concentration of the fuel vapor purged from the canister 26 into the intake passage 16 when the purge valve 28 is opened. The air-fuel ratio learning process is the process of updating the air-fuel ratio learning value KG to reduce an absolute value of a correction ratio δ calculated by a feedback control of the air-fuel ratio.

The function configuration of the controller 100 will now be described with reference to FIG. 4.

Figure 4:
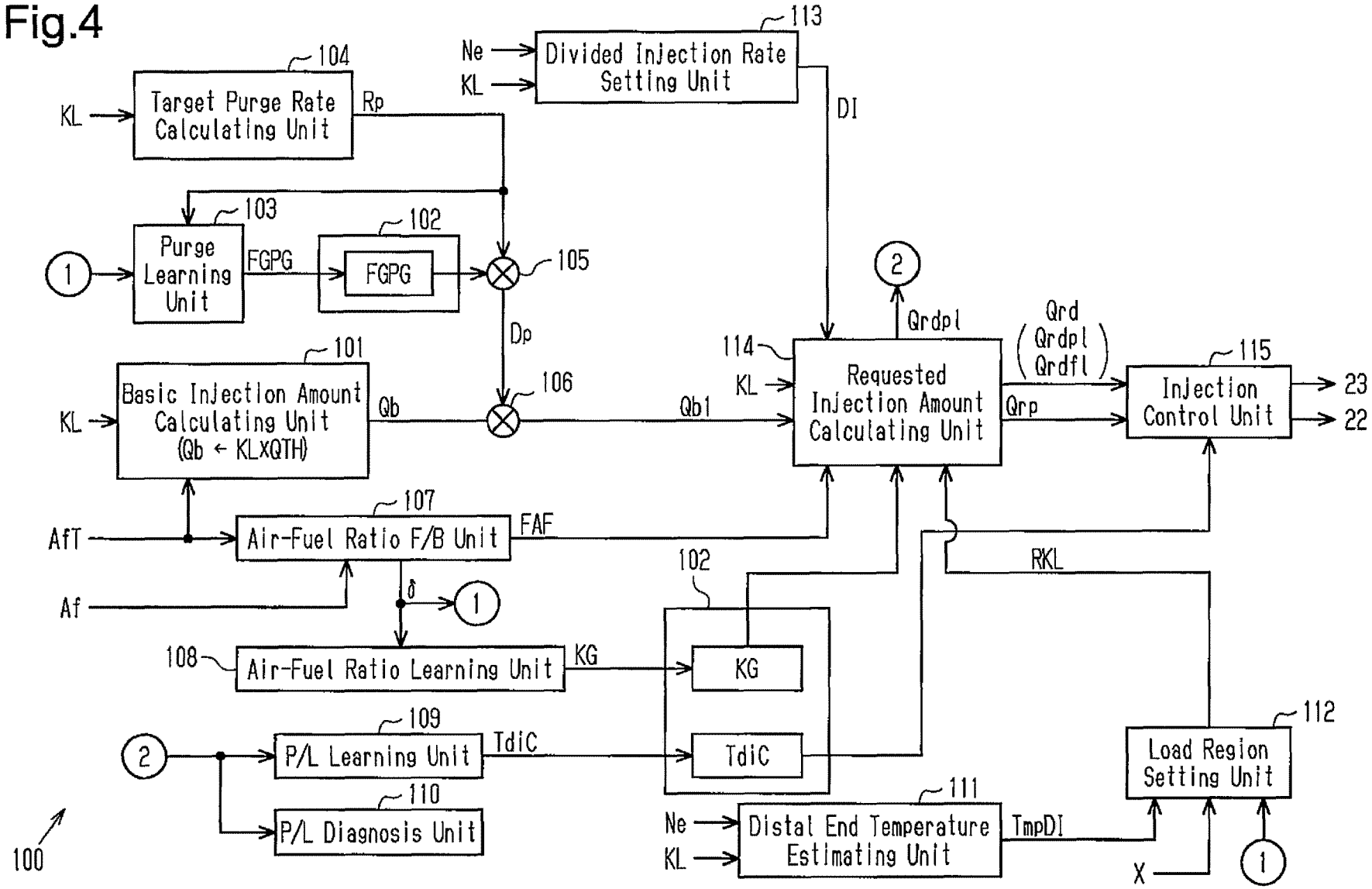
FIG. 4 is a block diagram showing the functions of the controller of FIG. 1.

As shown in FIG. 4, the controller 100 includes, as function units for controlling each injection valve 22, 23, a basic injection amount calculating unit 101, a storage unit 102, a purge learning unit 103, a target purge rate calculating unit 104, a first multiplying unit 105, a second multiplying unit 106, an air-fuel ratio feedback unit 107, an air-fuel ratio learning unit 108, a partial lift learning unit 109, a partial lift diagnosis unit 110, a distal end temperature estimating unit 111, a load region setting unit 112, a divided injection rate setting unit 113, a requested injection amount calculating unit 114, and an injection control unit 115. Hereinafter, the air-fuel ratio feedback unit 107 is referred to as "air-fuel ratio F/B unit 107", the partial lift learning unit 109 is referred to as "P/L learning unit 109", and the partial lift diagnosis unit 110 is referred to as "P/L diagnosis unit 110".

The basic injection amount calculating unit 101 calculates a basic injection amount Qb based on an engine load rate KL. The basic injection amount Qb is calculated as a product of a specified fully filled theoretical injection amount QTH and the engine load rate KL. A calculated value of the fuel injection amount when the engine load rate KL is "100%" and the air-fuel ratio detection value Af is equal to the target air-fuel ratio AfT is set as the fully filled theoretical injection amount QTH. Furthermore, the engine load rate KL can be calculated based on, for example, the engine rotation speed Ne and the incoming air amount Ga.

The storage unit 102 stores a purge concentration learning value FGPG, which is the result of learning by the purge learning process, the air-fuel ratio learning value KG, which is the result of learning by the air-fuel ratio learning process, and an energizing time correction value TdiC, which is the result of learning by the P/L learning process. The storage unit 102 is configured by a volatile memory. Thus, when power is not supplied to the storage unit 102 due to battery change and the like, the content stored in the storage unit 102 is deleted. In the present embodiment, a state in which the learning result of each learning process is not stored in the storage unit 102 is referred to as "initial state".

The purge learning unit 103 performs the purge learning process when the purge to the intake passage 16 of the fuel vapor collected by the canister 26 is permitted, that is, when the purge valve 28 is opened. For example, the purge learning unit 103 performs the purge learning process provided that the P/L learning process is interrupted when the storage unit 102 is in the initial state at the time of engine start. In such a purge learning process, the purge concentration learning value FGPG, which is the learning value of the purge concentration, is calculated based on the correction ratio δ calculated by the air-fuel ratio F/B unit 107 and a target purge rate Rp calculated by the target purge rate calculating unit 104, to be described later. The purge concentration learning value FGPG is then stored in the storage unit 102. The specific content of the purge learning process that is performed provided that the P/L learning process is interrupted will be described later using FIG. 5.

The target purge rate calculating unit 104 calculates the target purge rate Rp based on the engine load rate KL. The purge rate is the value obtained by dividing the flow rate of the fluid purged from the canister 26 to the intake passage 16 by the incoming air amount Ga, and the target purge rate Rp is the target value of the purge rate in control. The target purge rate Rp is also used when controlling the opening of the purge valve 28.

The first multiplying unit 105 calculates the product of the target purge rate Rp calculated by the target purge rate calculating unit 104 and the purge concentration learning value FGPG stored in the storage unit 102 as a purge correction ratio Dp.

The second multiplying unit 106 calculates the product of the basic injection amount Qb calculated by the basic injection amount calculating unit 101 and the purge correction ratio Dp calculated by the first multiplying unit 105 as a correction basic injection amount Qb1.

The air-fuel ratio F/B unit 107 calculates a feedback correction amount FAF to reduce a deviation of an air-fuel ratio detection value Af and a target air-fuel ratio AfT. The air-fuel ratio F/B unit 107 calculates a sum of a proportional element, an integral element, and a differential element having the deviation of the target air-fuel ratio AfT and the air-fuel ratio detection value Af as the input as a correction ratio δ. The air-fuel ratio F/B unit 107 then calculates the sum of the calculated correction ratio δ and "1" as a feedback correction amount FAF.

The air-fuel ratio learning unit 108 starts the air-fuel ratio learning process provided that the P/L learning process is interrupted when the storage unit 102 is in the initial state at the time of engine start. In the air-fuel ratio learning process, the air-fuel ratio learning value KG is updated for every predetermined control cycle so that the air-fuel ratio learning value KG is gradually changed. For example, when the air-fuel ratio learning value KG needs to be increased to put the correction ratio δ calculated by the air-fuel ratio F/B unit 107 closer to "0", the air-fuel ratio learning value KG is gradually increased. In this case, the air-fuel ratio learning value KG is incremented by an update value ΔKG for every control cycle. When the air-fuel ratio learning value KG needs to be reduced to put the correction ratio δ closer to "0", the air-fuel ratio learning value KG is gradually reduced. In this case, the air-fuel ratio learning value KG is decremented by the update value ΔKG for every control cycle. The air-fuel ratio learning value KG calculated by the air-fuel ratio learning process is then stored in the storage unit 102. When a state in which an absolute value of the correction ratio δ is smaller than or equal to a predetermined value is continued for longer than or equal to a predetermined time, the air-fuel ratio learning unit 108 completes the air-fuel ratio learning process.

In the present embodiment, the air-fuel ratio learning unit 108 appropriately changes the update value ΔKG used for the updating of the air-fuel ratio learning value KG when performing the air-fuel ratio learning process. In other words, when the P/L learning process is already completed, the air-fuel ratio learning unit 108 sets the update value ΔKG to be equal to a first value ΔKG1. When the P/L learning process is not yet completed, the air-fuel ratio learning unit 108 sets the update value ΔKG to be equal to a second value ΔKG2. The second value ΔKG2 is smaller than the first value ΔKG1. Thus, the updating speed of the air-fuel ratio learning value KG when the P/L learning process is not yet completed is smaller than the updating speed of the air-fuel ratio learning value KG when the P/L learning process is already completed.

The P/L learning unit 109 performs the P/L learning process when the storage unit 102 is in the initial state at the time of engine start. In the P/L learning process, when the P/L injection is performed by the in-cylinder injection valve 23, the injection characteristic of the in-cylinder injection valve 23 is learned so that divergence of a correlation value of the requested injection amount and a correlation value of the actual injection amount becomes small based on the correlation value of the present requested injection amount of the in-cylinder injection valve 23 and the correlation value of the actual injection amount of the in-cylinder injection valve 23 when the P/L injection is performed. In the present embodiment, the energizing time correction value TdiC, which is a correction value of the energizing time of the electromagnetic coil 53 of the in-cylinder injection valve 23, is learned as the injection characteristic of the in-cylinder injection valve 23. The injection characteristic of the in-cylinder injection valve 23 learned in such a manner is stored in the storage unit 102. The P/L learning process is interrupted when the learning of the injection characteristic of the in-cylinder injection valve 23 advances. Thereafter, the P/L learning process is resumed provided that the purge learning process is completed. The P/L learning process is completed when the divergence is less than a specified determination value. The specific content of the P/L learning process will be described later using FIG. 6.

The P/L diagnosis unit 110 performs a diagnosis process of diagnosing whether or not the P/L injection is normally performed provided that the P/L learning process is completed. The specific content of the diagnosis process will be described later using FIG. 7.

The distal end temperature estimating unit 111 calculates a distal end temperature estimated value TmpDI, which is an estimated value of the temperature of a peripheral portion of the nozzle body 57, which is the distal end of the in-cylinder injection valve 23, that is, the injection hole 571 of the in-cylinder injection valve 23. For example, the distal end temperature estimating unit 111 calculates the distal end temperature estimated value TmpDI based on the engine load rate KL and the engine rotation speed Ne. In this case, the distal end temperature estimating unit 111 calculates the distal end temperature estimated value TmpDI so that the distal end temperature estimated value TmpDI becomes higher as the engine load rate KL is higher. Furthermore, the distal end temperature estimating unit 111 calculates the distal end temperature estimated value TmpDI so that the distal end temperature estimated value TmpDI becomes higher as the engine rotation speed Ne increases.

The load region setting unit 112 sets a specified load region RKL, which is a region for causing the in-cylinder injection valve 23 to perform the P/L injection even when the engine load rate KL is relatively high. In other words, the load region setting unit 112 calculates an upper limit RKLul and a lower limit RKLll of the specified load region RKL based on the distal end temperature estimated value TmpDI calculated by the distal end temperature estimating unit 111, the correction ratio δ calculated by the air-fuel ratio F/B unit 107, and the P/L injection execution number X during a period during which the P/L learning process is being performed. A specific calculating method of the upper limit RKLul and the lower limit RKLll of the specified load region RKL will be described later using FIG. 8.

The divided injection rate setting unit 113 derives a divided injection rate DI of the passage injection valve 22 and the in-cylinder injection valve 23 based on the engine load rate KL and the engine rotation speed Ne. The divided injection rate DI is a value obtained by dividing the fuel injection amount of the passage injection valve 22 by a total amount of fuel supplied into the cylinder 11.

The requested injection amount calculating unit 114 calculates a requested injection amount Qrp with respect to the passage injection valve 22 and a requested injection amount Qrd (Qrdpl, Qrdfl) of the in-cylinder injection valve 23 based on the divided injection rate DI set by the divided injection rate setting unit 113, the correction basic injection amount Qb1 calculated by the second multiplying unit 106, the feedback correction amount FAF calculated by the air-fuel ratio F/B unit 107, and the air-fuel ratio learning value KG stored in the storage unit 102.

The requested injection amount calculating unit 114 allocates the correction basic injection amount Qb1 to a basic injection amount Qb1*p* for the passage injection valve 22 and a basic injection amount Qb1*d* for the in-cylinder injection valve 23 based on the divided injection rate DI. The requested injection amount calculating unit 114 calculates the requested injection amount Qrp with respect to the passage injection valve 22 based on the basic injection amount Qb1*p*, the feedback correction amount FAF, and the air-fuel ratio learning value KG. In this case, under the condition that the air-fuel ratio learning value KG is equal to "1", when the feedback correction amount FAF is smaller than "1" because the correction ratio δ is a negative value, the requested injection amount Qrp with respect to the passage injection valve 22 is less than the basic injection amount Qb1*p*. Furthermore, under the condition that the feedback correction amount FAF is equal to "1", when the air-fuel ratio learning value KG is smaller than "1", the requested injection amount Qrp with respect to the passage injection valve 22 is less than the basic injection amount Qb1*p*.

The requested injection amount calculating unit 114 calculates the requested injection amount Qrd of the in-cylinder injection valve 23 based on the basic injection amount Qb1*d* for the in-cylinder injection valve 23, the feedback correction amount FAF, and the air-fuel ratio learning value KG. In this case, under the condition that the air-fuel ratio learning value KG is equal to "1", when the feedback correction amount FAF is smaller than "1" because the correction ratio δ is a negative value, the requested injection amount Qrd of the in-cylinder injection valve 23 is less than the basic injection amount Qb1*d*. Furthermore, under the condition that the feedback correction amount FAF is equal to "1", when the air-fuel ratio learning value KG is smaller than "1", the requested injection amount Qrd of the in-cylinder injection valve 23 is less than the basic injection amount Qb1*d*.

When causing the in-cylinder injection valve 23 to perform the fuel injection under a situation that the engine operation is being performed in the specified load region RKL set by the load region setting unit 112, the requested injection amount calculating unit 114 calculates the requested injection amount Qrdpl for the P/L injection and the requested injection amount Qrdfl for the F/L injection as the requested injection amount Qrd of the in-cylinder injection valve 23.

Thus, when the requested injection amount Qrdpl for the P/L injection and the requested injection amount Qrdfl for the F/L injection are calculated, the requested injection amount Qrdpl for the P/L injection may become smaller than the injection amount lower limit value QrdplLL. In this case, the requested injection amount Qrdfl for the F/L injection and the requested injection amount Qrp with respect to the passage injection valve 22 are corrected so that the requested injection amount Qrdpl for the P/L injection becomes greater than or equal to the injection amount lower limit value QrdplLL. Furthermore, when it is difficult for the requested injection amount Qrdpl for the P/L injection to become greater than or equal to the injection amount lower limit value QrdplLL even if the requested injection amount Qrdfl for the F/L injection and the requested injection amount Qrp with respect to the passage injection valve 22 are corrected, the implementation of the P/L injection is prohibited.

The injection control unit 115 controls the drive of the passage injection valve 22 and the in-cylinder injection valve 23 based on the calculation result of the requested injection amount calculating unit 114. In other words, the injection control unit 115 drives the passage injection valve 22 based on the requested injection amount Qrp with respect to the passage injection valve 22. In this case, the injection control unit 115 extends the energizing time of the electromagnetic coil of the passage injection valve 22 as the requested injection amount Qrp increases.

Furthermore, the injection control unit 115 drives the in-cylinder injection valve 23 based on the requested injection amount Qrd (Qrdpl and Qrdfl) of the in-cylinder injection valve 23. When dividing the fuel injection of the in-cylinder injection valve 23 to a plurality of times including the P/L injection and the F/L injection, the injection control unit 115 drives the in-cylinder injection valve 23 based on the requested injection amount Qrdfl for the F/L injection. In this case, the injection control unit 115 extends the energizing time of the electromagnetic coil 53 of the in-cylinder injection valve 23 as the requested injection amount Qrdfl increases. Thus, the injection control unit 115 can cause the in-cylinder injection valve 23 to perform the F/L injection.

Furthermore, the injection control unit 115 drives the in-cylinder injection valve 23 based on the requested injection amount Qrdpl for the P/L injection. In other words, the injection control unit 115 calculates a basic energizing time TdiB so that the basic energizing time TdiB becomes longer as the requested injection amount Qrdpl increases. Moreover, the injection control unit 115 reads out the energizing time correction value TdiC, which is the learning result of the P/L learning process, stored in the storage unit 102, and calculates the sum of the basic energizing time TdiB and the energizing time correction value TdiC as a request energizing time TdiR. The injection control unit 115 then causes the in-cylinder injection valve 23 to perform the P/L injection by continuing the flow of current to the electromagnetic coil 53 of the in-cylinder injection valve 23 by the request energizing time TdiR.

In the present embodiment, when dividing the fuel injection of the in-cylinder injection valve 23 to a plurality of times including the P/L injection and the F/L injection because the engine operation is performed in the specified load region RKL, the injection control unit 115 causes the in-cylinder injection valve 23 to perform the P/L injection and thereafter causes the in-cylinder injection valve 23 to perform the F/L injection.

Next, the processing routine executed by the purge learning unit 103 to perform the purge learning process will be described with reference to FIG. 5. The present processing routine is executed for every predetermined control cycle when both the implementation of the P/L learning process is interrupted and the purge learning process is not completed are satisfied.

Figure 5:
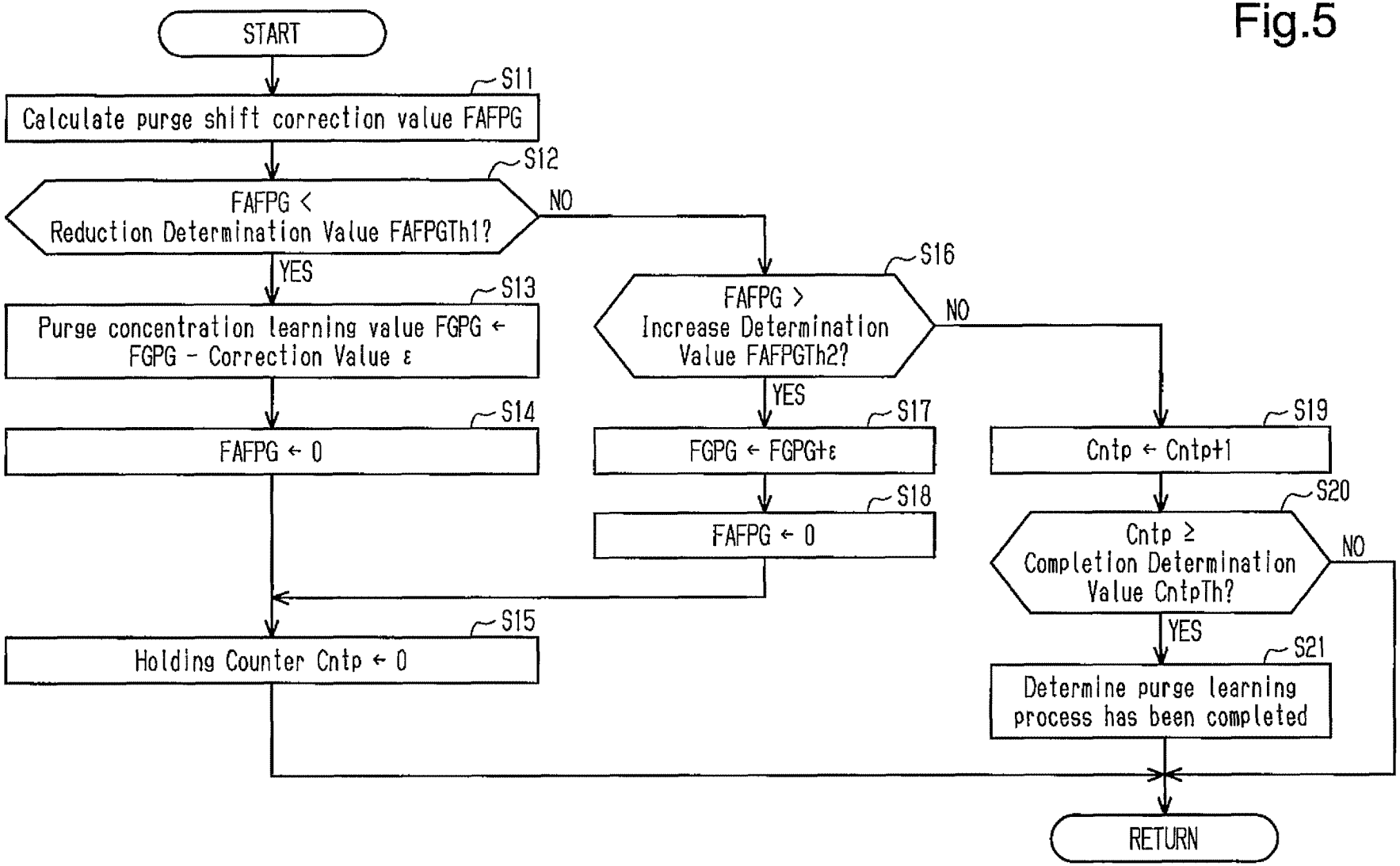
FIG. 5 is a flowchart illustrating a processing routine for performing a purge learning process.

As shown in FIG. 5, in the present processing routine, the purge learning unit 103 calculates a purge shift correction value FAFPG using a relational expression (expression 1) shown below (S11). "δav" in the relational expression (expression 1) is an average value of the correction ratio δ calculated by the air-fuel ratio F/B unit 107, and "Rp" is a target purge rate calculated by the target purge rate calculating unit 104. Furthermore, "γ" is a weighting coefficient, and is set to a value greater than "0" and smaller than "1". The purge shift correction value FAFPG is a value correlated to a certain extent with the deviation of a most recent value of the purge concentration learning value FGPG and the actual purge concentration.

Expression 1

$$FAFPG \leftarrow FAFPG + \left(\frac{\delta av}{Rp} - FAFPG\right) \times \gamma \qquad (式1)$$

Next, the purge learning unit 103 determines whether or not the calculated purge shift correction value FAFPG is smaller than a reduction determination value FAFPGTh1 (S12). The reduction determination value FAFPGTh1 is set to a value with which determination can be made on whether or not the purge concentration indicated by the most recent value of the purge concentration learning value FGPG is lower than the actual purge concentration based on the purge shift correction value FAFPG. Thus, when the purge shift correction value FAFPG is smaller than the reduction determination value FAFPGTh1, the purge concentration indicated by the most recent value of the purge concentration learning value FGPG is determined to be lower than the actual purge concentration. When the purge shift correction value FAFPG is greater than or equal to the reduction determination value FAFPGTh1, the purge concentration indicated by the most recent value of the purge concentration learning value FGPG is not determined to be lower than the actual purge concentration.

When the purge shift correction value FAFPG is smaller than the reduction determination value FAFPGTh1 (S12: Yes), the purge learning unit 103 calculates a value, in which a correction value ε is subtracted from the purge concentration learning value FGPG, as a new purge concentration learning value FGPG, and stores this purge concentration learning value FGPG in the storage unit 102 (S13). The correction value ε is a value for updating the purge concentration learning value FGPG, and is set to a positive value. Next, the purge learning unit 103 resets the purge shift correction value FAFPG to "0" (S14), and resets a holding counter Cntp, to be described later, to "0" (S15). Thereafter, the purge learning unit 103 once terminates the present processing routine.

When the purge shift correction value FAFPG is greater than or equal to the reduction determination value FAFPGTh1 in step S12 (NO), the purge learning unit 103 determines whether or not the purge shift correction value FAFPG is greater than an increase determination value FAFPGTh2 (S16). The increase determination value FAFPGTh2 is set to a value with which determination can be made on whether or not the purge concentration indicated by the most recent value of the purge concentration learning value FGPG is higher than the actual purge concentration based on the purge shift correction value FAFPG. That is, the increase determination value FAFPGTh2 is set to a value greater than the reduction determination value FAFPGTh1. When the purge shift correction value FAFPG is greater than the increase determination value FAFPGTh2, the purge concentration indicated by the most recent value of the purge concentration learning value FGPG is determined to be higher than the actual purge concentration. When the purge shift correction value FAFPG is smaller than or equal to the increase determination value FAFPGTh2, the purge concentration indicated by the most recent value of the purge concentration learning value FGPG is not determined to be higher than the actual purge concentration.

When the purge shift correction value FAFPG is greater than the increase determination value FAFPGTh2 (S16: YES), the purge learning unit 103 calculates the sum of the purge concentration learning value FGPG and the correction value ε as a new purge concentration learning value FGPG, and stores this purge concentration learning value FGPG in the storage unit 102 (S17). Next, the purge learning unit 103 resets the purge shift correction value FAFPG to "0" (S18), and thereafter, the process proceeds to step S15 described above.

When the purge shift correction value FAFPG is smaller than or equal to the increase determination value FAFPGTh2 in step S16 (NO), the purge learning unit 103 increments the holding counter Cntp by "1" (S19). The purge learning unit 103 determines whether or not the holding counter Cntp is greater than or equal to a completion determination value CntpTh (S20). The completion determination value CntpTh is set to an integer greater than "1". When the holding counter Cntp is greater than or equal to the completion determination value CntpTh, determination is made that a state in which the purge concentration learning value FGPG is held is continued to a certain extent. When the holding counter Cntp is smaller than the completion determination value CntpTh, determination is not made that a state in which the purge concentration learning value FGPG is held is continued to a certain extent.

When the holding counter Cntp is greater than or equal to the completion determination value CntpTh (S20: YES), the purge learning unit 103 determines that the purge learning process has been completed (S21), and thereafter, terminates the present processing routine. In other words, the purge learning unit 103 completes the purge learning process. When the holding counter Cntp is smaller than the completion determination value CntpTh (S20: NO), the purge learning unit 103 terminates the present processing routine without performing the process of step S21. In other words, the purge learning unit 103 continues the purge learning process.

The processing routine executed by the P/L learning unit 109 to perform the P/L learning process will now be described with reference to FIG. 6. The present processing routine is executed whenever the in-cylinder injection valve 23 performs the P/L injection until it is determined that the P/L learning process is completed.

Figure 6:
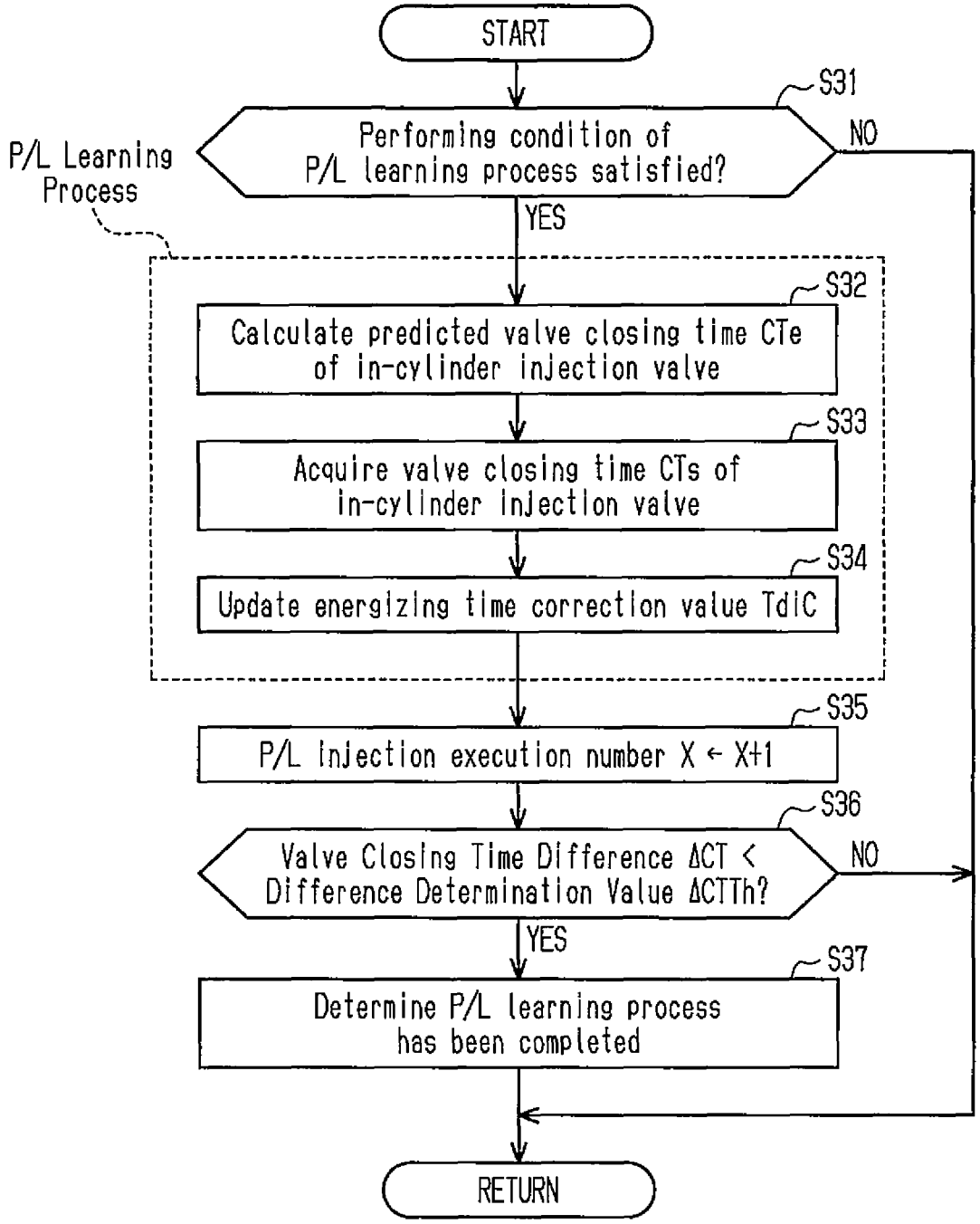
FIG. 6 is a flowchart illustrating a processing routine for performing a partial lift learning process.

As shown in FIG. 6, in the present processing routine, the P/L learning unit 109 determines whether or not the performing condition of the P/L learning process is satisfied (S31). The P/L learning unit 109 determines that the performing condition of the P/L learning process is satisfied when either one of the following two conditions is satisfied. (Condition 1) The P/L injection execution number X from the start of the engine operation is smaller than or equal to a specified number XTh. (Condition 2) The purge learning process is completed.

Although specifically described later, the learning of the injection characteristic of the in-cylinder injection valve 23 during the P/L injection advances as the P/L injection execution number X increases. The specified number XTh is set to a value with which determination can be made on whether or not the learning of the injection characteristic of the in-cylinder injection valve 23 by the P/L learning process has advanced to a certain extent.

When the performing condition of the P/L learning process is not satisfied (S31: NO), that is, when neither condition 1 nor condition 2 is satisfied, the P/L learning unit 109 once terminates the present processing routine. When the performing condition is satisfied (S31: YES), that is, when condition 1 or condition 2 is satisfied, the P/L learning unit 109 performs the P/L learning process composed of a series of processes of steps S32, S33, and S34. In other words, the P/L learning unit 109 first calculates a predicted valve closing time CTe, which is a predicted value of the valve closing time of the in-cylinder injection valve 23 during P/L injection, based on the requested injection amount Qrdpl for the P/L injection calculated by the requested injection amount calculating unit 114 (S32). The predicted valve closing time CTe is the predicted value of the time at which the current flow to the electromagnetic coil 53 of the in-cylinder injection valve 23 is terminated. The energizing time of the electromagnetic coil 53 is correlated with the requested injection amount Qrdpl, and becomes longer as the requested injection amount Qrdpl increases. Therefore, the predicted valve closing time CTe corresponds to one example of "correlation value of requested injection amount Qrdpl".

Next, the P/L learning unit 109 acquires a valve closing time CTs of the in-cylinder injection valve 23 when the P/L injection is performed by the in-cylinder injection valve 23 (S33). In other words, the P/L learning unit 109 can acquire the valve closing time CTs by monitoring the transition of the current value flowing to the electromagnetic coil 53. The actual energizing time of the electromagnetic coil 53 is longer and the valve closing time CTs is later as the actual injection amount of the in-cylinder injection valve 23 increases. Therefore, the valve closing time CTs corresponds to one example of "correlation value of actual injection amount".

The P/L learning unit 109 then updates the energizing time correction value TdiC based on the predicted valve closing time CTe and the valve closing time CTs, and stores the updated energizing time correction value TdiC in the storage unit 102 (S34). In other words, the energizing time correction value TdiC is stored in the storage unit 102 as the injection characteristic of the in-cylinder injection valve 23 during the P/L injection. When the valve closing time CTs is earlier than the predicted valve closing time CTe, determination can be made that the actual injection amount of the in-cylinder injection valve 23 during the P/L injection is smaller than the requested injection amount Qrdpl, and thus the P/L learning unit 109 corrects the energizing time correction value TdiC by increasing. When the valve closing time CTs is later than the predicted valve closing time CTe, determination can be made that the actual injection amount of the in-cylinder injection valve 23 during the P/L injection is greater than the requested injection amount Qrdpl, and thus the P/L learning unit 109 corrects the energizing time correction value TdiC by reducing.

The P/L learning unit 109 then increments the P/L injection execution number X by "1" (S35). The P/L learning unit 109 then determines whether or not a valve closing time difference ΔCT, which is a difference between the predicted valve closing time CTe and the valve closing time CTs, is smaller than a difference determination value ΔCTTh (S36). The difference determination value ΔCTTh is set to a value with which determination can be made that there is hardly any divergence between the predicted valve closing time CTe and the valve closing time CTs. Thus, when the valve closing time difference ΔCT is smaller than the difference determination value ΔCTTh, determination is made that there is hardly any divergence. When the valve closing time difference ΔCT is greater than or equal to the difference determination value ΔCTTh, determination that there is hardly any divergence is not made. In other words, in the present embodiment, the valve closing time difference ΔCT corresponds to one example of "divergence of correlation value of requested injection amount and correlation value of actual injection amount", and the difference determination value ΔCTTh corresponds to one example of "defined determination value".

When the valve closing time difference ΔCT is smaller than the difference determination value ΔCTTh (S36: YES), the P/L learning unit 109 determines that the P/L learning process has been completed (S37), and then terminates the present processing routine. In other words, the P/L learning unit 109 completes the P/L learning process. When the valve closing time difference ΔCT is greater than or equal to the difference determination value ΔCTTh (S36: NO), the P/L learning unit 109 once terminates the present processing routine without performing the process of step S37. In other words, the P/L learning unit 109 continues the P/L learning process.

In the P/L learning process, the energizing time correction value TdiC is updated so that the closing time difference ΔCT gradually decreases. The specified number XTh used when determining that the learning of the energizing time correction value TdiC has advanced to a certain extent is set in advance to such a value that the execution number X reaches the specified number XTh before the valve closing time difference ΔCT is less than the difference determination value ΔCTTh.

Next, the processing routine executed by the P/L diagnosis unit 110 to perform the diagnosis process will be described with reference to FIG. 7. The present processing routine is executed whenever the in-cylinder injection valve 23 performs the P/L injection from after the P/L learning process is completed until determination is made that the diagnosis process is completed.

Figure 7:
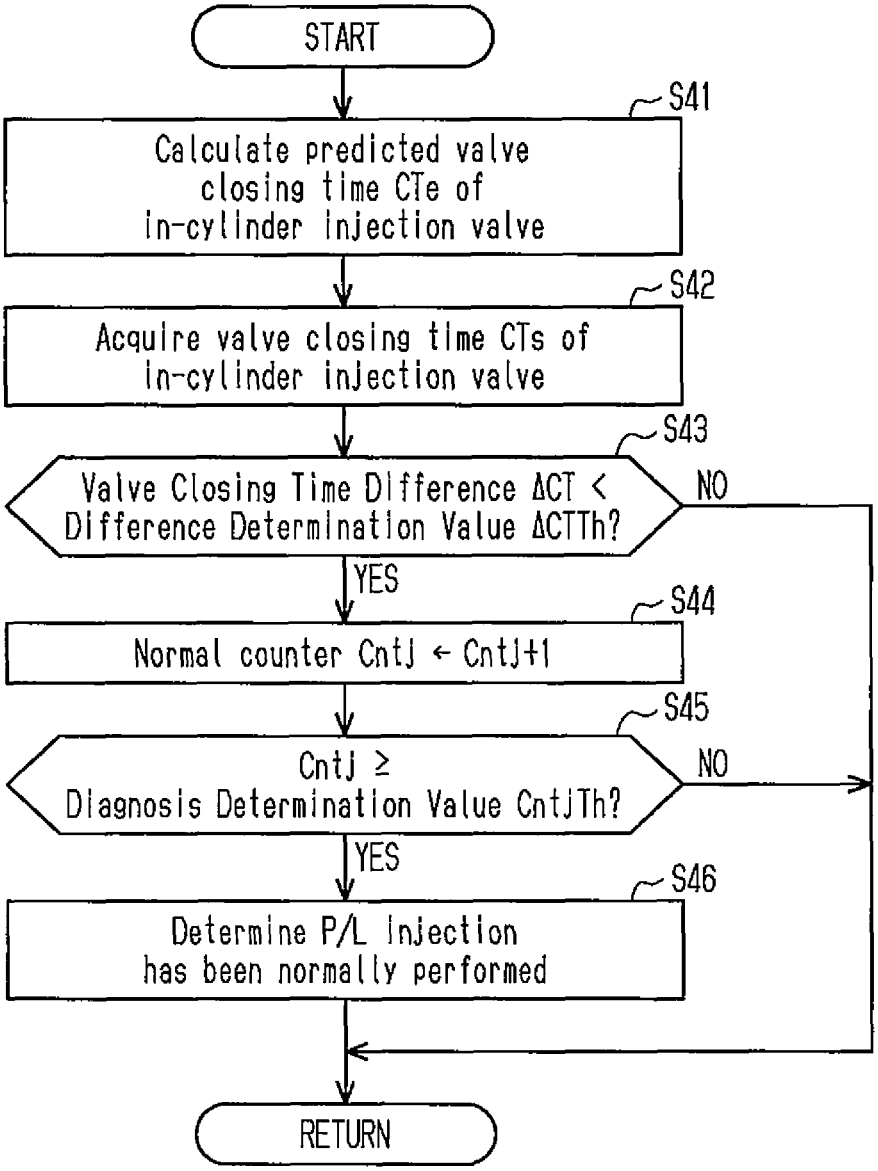
FIG. 7 is a flowchart illustrating a processing routine for performing a diagnosis process.

As shown in FIG. 7, in the present processing routine, the P/L diagnosis unit 110 performs the diagnosis process. In other words, the P/L diagnosis unit 110 first calculates the predicted valve closing time CTe based on the requested injection amount Qrdpl for the P/L injection calculated by the requested injection amount calculating unit 114 (S41), similarly to step S32. Next, the P/L diagnosis unit 110 acquires the valve closing time CTs of the in-cylinder injection valve 23 when the P/L injection is performed by the in-cylinder injection valve 23 (S42), similarly to step S33. The P/L diagnosis unit 110 then determines whether or not the valve closing time difference ΔCT, which is a difference between the predicted valve closing time CTe and the valve closing time CTs, is smaller than the difference determination value ΔCTTh (S43), similarly to step S36.

When the valve closing time difference ΔCT is greater than or equal to the difference determination value ΔCTTh (S43: NO), the P/L diagnosis unit 110 once terminates the present processing routine. When the valve closing time difference ΔCT is smaller than the difference determination value ΔCTTh (S43: YES), the P/L diagnosis unit 110 increments a normal counter Cntj by "1" (S44). The normal counter Cntj is held at "0" until the P/L learning process is completed.

The P/L diagnosis unit 110 then determines whether or not the updated normal counter Cntj is greater than or equal to a diagnosis determination value CntjTh (S45). The diagnosis determination value CntjTh is set to a value with which determination can be made on whether or not the P/L injection by the in-cylinder injection valve 23 is normally performed after the P/L learning process is completed. Thus, when the normal counter Cntj is greater than or equal to the diagnosis determination value CntjTh, determination is made that the P/L injection is normally performed. When the normal counter Cntj is smaller than the diagnosis determination value CntjTh, determination that the P/L injection is normally performed is not made.

When the normal counter Cntj is greater than or equal to the diagnosis determination value CntjTh (S45: YES), the P/L diagnosis unit 110 determines that the P/L injection has been normally performed (S46), and thereafter, terminates the present processing routine. In other words, the P/L learning unit 109 completes the diagnosis process. When the normal counter Cntj is smaller than the diagnosis determination value CntjTh (S45: NO), the P/L diagnosis unit 110 once terminates the present processing routine without performing the process of step S46. In other words, the P/L learning unit 109 continues the diagnosis process.

The processing routine executed by the load region setting unit 112 to set the upper limit RKLul and the lower limit RKLll of the specified load region RKL will now be described with reference to FIG. 8. The present processing routine is executed for every predetermined control cycle. Furthermore, dividing the fuel injection of the in-cylinder injection valve 23 to a plurality of times including the P/L injection because the engine operation is being performed in the specified load region RKL is also referred to as "P/L active".

Figure 8:
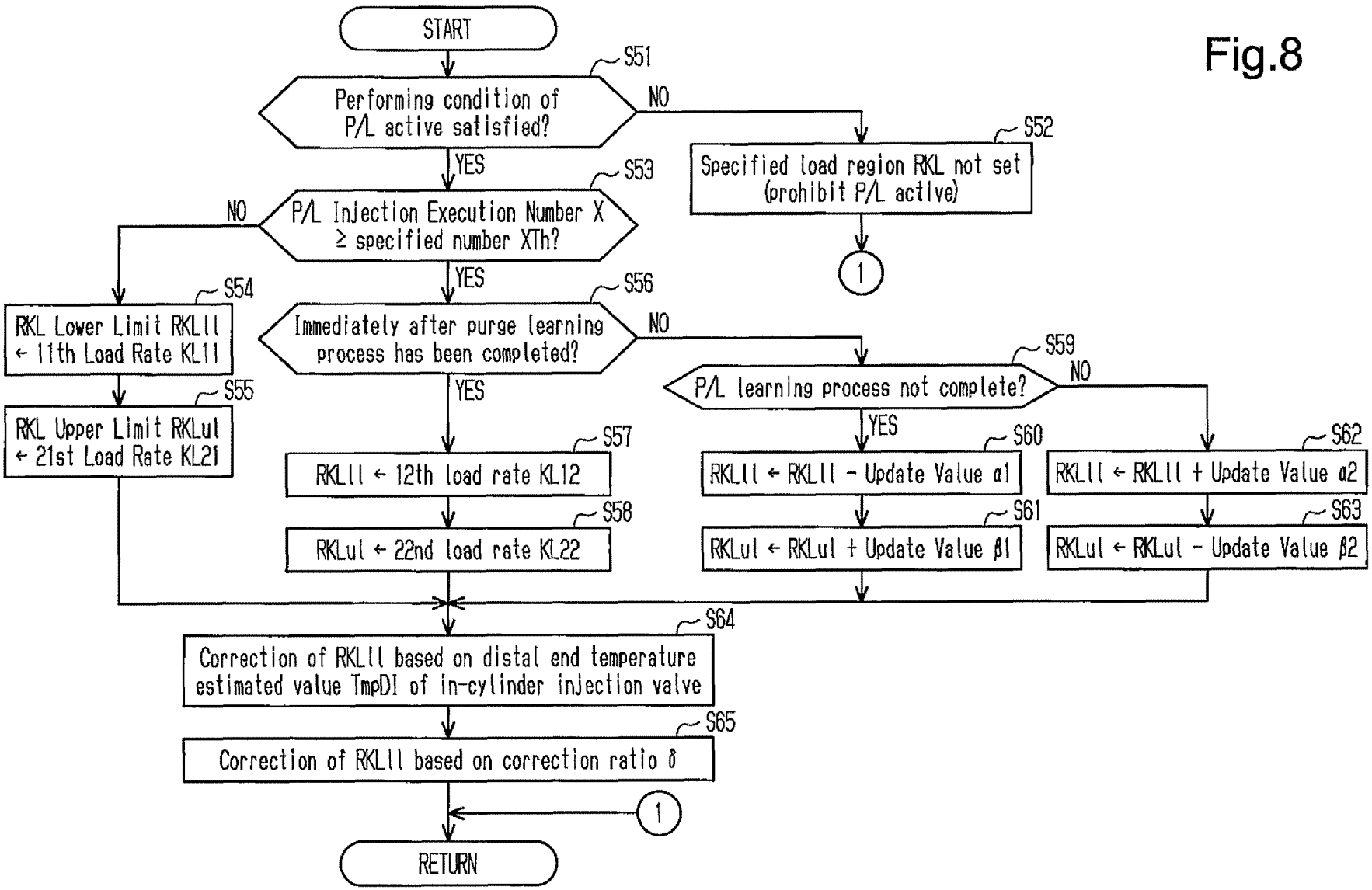
FIG. 8 is a flowchart illustrating a processing routine for setting a specified load region.

As shown in FIG. 8, in the present processing routine, the load region setting unit 112 determines whether or not the performing condition of the P/L active is satisfied (S51). In other words, the load region setting unit 112 determines that the performing condition of the P/L active is satisfied when the performing condition of the P/L learning process is satisfied or when the performing condition of the diagnosis process is satisfied. When the performing condition of the P/L active is not satisfied (S51: NO), the load region setting unit 112 does not set the specified load region RKL, that is, prohibits the P/L active (S52). Thereafter, the load region setting unit 112 once terminates the present processing routine.

When the performing condition of the P/L active is satisfied in step S51 (YES), the load region setting unit 112 determines whether or not the P/L injection execution number X by the in-cylinder injection valve 23 is greater than or equal to the specified number XTh (S53). While determination is made that the purge learning process is not yet performed when the execution number X is smaller than the specified number XTh, determination is made that the purge learning process is already completed when the execution number X is greater than or equal to the specified number XTh.

When the execution number X is smaller than the specified number XTh (S53: NO), the load region setting unit 112 sets the lower limit RKLll of the specified load region RKL to be equal to the 11th load rate KL11 (S54). The load region setting unit 112 then sets the upper limit RKLul of the specified load region RKL to be equal to the 21st load rate KL21 (S55). The 21st load rate KL21 is set to a value greater than the 11th load rate KL11. The load region setting unit 112 then causes the process to proceed to step S64, to be described later.

When the P/L injection execution number X is greater than or equal to the specified number XTh in step S53 (YES), the load region setting unit 112 determines whether or not it is immediately after the purge learning process has been completed (S56). For example, the load region setting unit 112 can determine it to be immediately after the completion of the purge learning process when performing the determination of step S56 for the first time after the purge learning process is completed. When it is immediately after the purge learning process has been completed (S56: YES), the load region setting unit 112 sets the lower limit RKLll of the specified load region RKL to be equal to the 12th load rate KL12 (S57). The 12th load rate KL12 is a value greater than the 11th load rate KL11 and smaller than the 21st load rate KL21. The load region setting unit 112 then sets the upper limit RKLul of the specified load region RKL to be equal to the 22nd load rate KL22. The 22nd load rate KL22 is set to a value that satisfies both a value being greater than the 21st load rate KL21, and a difference between the 22nd load rate KL22 and the 12th load rate KL12 being smaller than a difference between the 11th load rate KL11 and the 21st load rate KL21. Thereafter, the load region setting unit 112 causes the process to proceed to step S64, to be described later.

When it is not immediately after the purge learning process has been completed in step S56 (NO), the load region setting unit 112 determines whether or not the P/L learning process is not completed (S59). When the P/L learning process is not completed (S59: YES), the load region setting unit 112 calculates a difference obtained by subtracting an update value α1 from the lower limit RKLll of the specified load region RKL, as a new lower limit RKLll (S60). The update value α1 is set to a positive value. Thus, when the P/L learning process is not completed after the purge learning process is completed, the lower limit RKLll decreases as the P/L injection execution number X becomes greater. The load region setting unit 112 then calculates a sum of the upper limit RKLul of the specified load region RKL and an update value β1 as a new upper limit RKLul (S61). The update value β1 is set to a positive value. Thus, when the P/L learning process is not completed after the purge learning process is completed, the upper limit RKLul becomes greater as the P/L injection execution number X becomes greater. The update value β1 may be a value equal to the update value α1 or may be a value different from the update value α1. Thereafter, the load region setting unit 112 causes the process to proceed to step S64, to be described later.

When the P/L learning process is already completed in step S59 (NO), that is, when the diagnosis process is performed, the load region setting unit 112 calculates a sum of the lower limit RKLll of the specified load region RKL and an update value α2 as a new lower limit RKLll (S62). The update value α2 is set to a positive value. Thus, when the diagnosis process is still performed after the P/L learning process is completed, the lower limit RKLll becomes greater as the P/L injection execution number X becomes greater. The update value α2 may be a value equal to the update value α1 or may be a value different from the update value α1.

The load region setting unit 112 then calculates a difference obtained by subtracting an update value β2 from the upper limit RKLul of the specified load region RKL, as a new upper limit RKLul (S63). The update value β2 is set to a positive value. Thus, when the diagnosis process is still performed after the P/L learning process is completed, the upper limit RKLul decreases as the P/L injection execution number X becomes greater. The update value β2 may be a value equal to the update value α2 or may be a value different from the update value α2. Thereafter, the load region setting unit 112 causes the process to proceed to step S64.

In step S64, the load region setting unit 112 corrects the lower limit RKLll of the specified load region RKL based on the distal end temperature estimated value TmpDI calculated by the distal end temperature estimating unit 111. In other words, the load region setting unit 112 corrects the lower limit RKLll so that the lower limit RKLll decreases as the distal end temperature estimated value TmpDI is lower. The load region setting unit 112 then corrects the lower limit RKLll of the specified load region RKL based on the correction ratio δ calculated by the air-fuel ratio F/B unit 107 (S65). In other words, when the correction ratio δ is a negative value, the feedback correction amount FAF becomes a value smaller than "1", and thus the load region setting unit 112 corrects the lower limit RKLll so that the lower limit RKLll becomes greater as the absolute value of the correction ratio δ increases. When the correction ratio δ is "0" or a positive value, the load region setting unit 112 does not perform the correction of the lower limit RKLll based on the correction ratio δ. Thereafter, the load region setting unit 112 once terminates the present processing routine.

The operation and advantage of the present embodiment will now be described with reference to FIGS. 9 and 10.

Figure 9:
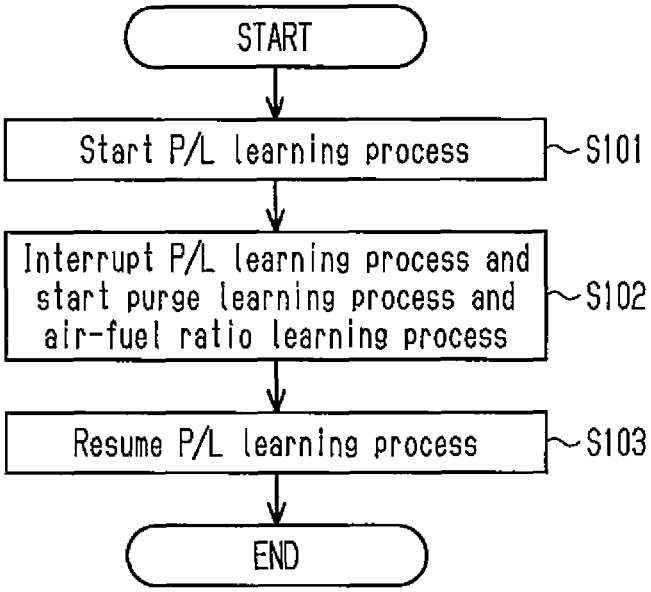
FIG. 9 is a flowchart illustrating a procedure for performing each learning process.

When the storage unit 102 is in the initial state at the time of engine start, as shown in FIG. 9, step S101 of closing the purge valve 28, and then causing the in-cylinder injection valve 23 to perform the P/L injection and learning the injection characteristic (i.e., energizing time correction value TdiC) of the in-cylinder injection valve 23 through the P/L learning process whenever the P/L injection is performed is executed by the controller 100.

Figure 10:
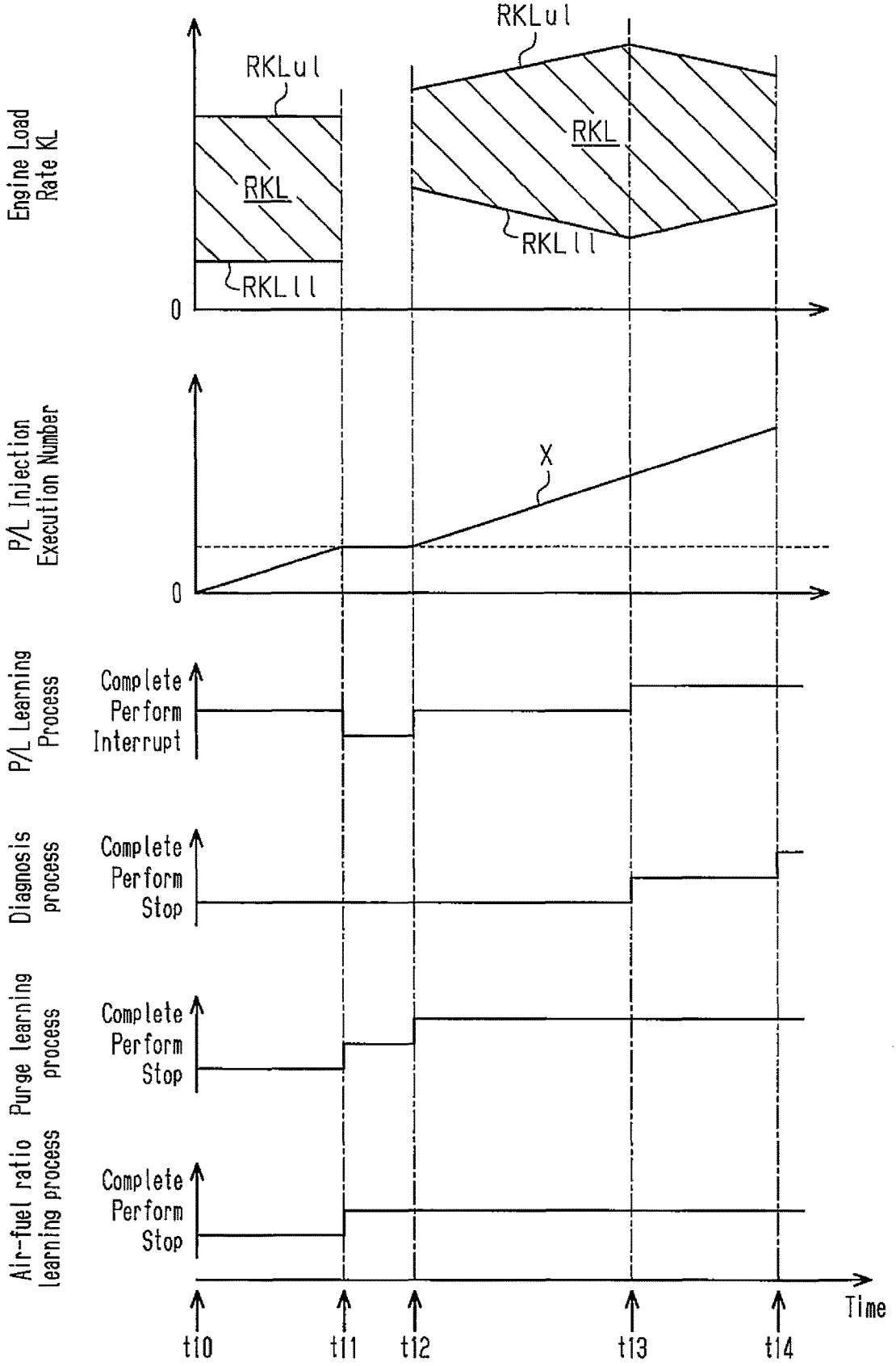
FIG. 10 is a timing chart of a case when the learning result of each learning process is not stored in a storage unit at time of engine start.

In this case, as shown in FIG. 10, the specified load region RKL is first set. When the divided injection rate DI is not "1" under a situation that the engine operation is performed in the specified load region RKL, the fuel injection of the in-cylinder injection valve 23 is divided to a plurality of times (e.g., two times) including the P/L injection. The injection characteristic (i.e., energizing time correction value TdiC) of the in-cylinder injection valve 23 is learned through the P/L learning process when the P/L injection is performed by the in-cylinder injection valve 23.

As the P/L injection execution number X increases, the learning of the energizing time correction value TdiC by the P/L learning process advances, and thus the divergence of the requested injection amount Qrdpl of the P/L injection and the actual injection amount of the in-cylinder injection valve 23 gradually decreases. In other words, when the P/L injection execution number X is small, it can be said that the energizing time correction value TdiC by the P/L learning process is not greatly advanced. When the P/L injection is performed under a situation that the learning of the energizing time correction value TdiC is not greatly advanced, the divergence tends to become large. Therefore, when the purge valve 28 is opened and the purge learning process is performed under the situation that the learning of the energizing time correction value TdiC is not greatly advanced, the divergence is greatly reflected on the learning result of the purge learning process. As a result, the learning accuracy of the purge concentration learning value FGPG by the purge learning process may become low.

In this respect, in the present embodiment, when the storage unit 102 is in the initial state at the time of engine start, the P/L learning process is performed in a state where the purge learning process and the air-fuel ratio learning process are both not performed. Thus, the learning of the energizing time correction value TdiC is advanced to a certain extent by the P/L learning process while neither the purge learning process nor the air-fuel ratio learning process is not performed, and hence the divergence of the requested injection amount Qrdpl of the P/L injection and the actual injection amount of the in-cylinder injection valve 23 can be reduced to a certain extent.

When the P/L injection execution number X reaches the specified number XTh at timing t11, determination can be made that the divergence of the requested injection amount Qrdpl of the P/L injection and the actual injection amount of the in-cylinder injection valve 23 is reduced to a certain extent. Thus, as shown in FIG. 9, step S102 of interrupting the P/L learning process before the P/L learning process is completed, and then opening the purge valve 28 to perform the purge learning process and starting the air-fuel ratio learning process is executed by the controller 100.

When the P/L learning process is interrupted as shown in FIG. 10, the specified load region RKL cannot be set. In other words, the divided injection including the P/L injection is not performed by the in-cylinder injection valve 23. Furthermore, the P/L injection may be performed by the in-cylinder injection valve 23 even if the specified load region RKL is not set depending on the engine operation region where the engine operation is performed. Even if the P/L injection is performed during the interruption of the P/L learning process, the learning accuracy of the purge concentration learning value FGPG by the purge learning process is less likely to lower because the divergence of the requested injection amount Qrdpl of the P/L injection and the actual injection amount of the in-cylinder injection valve 23 is reduced to a certain extent.

When it is determined that the purge concentration learning value FGPG is converged to a value at timing t12, the purge learning process is completed. Then, as shown in FIG. 9, step S103 of resuming the P/L learning process while continuing the air-fuel ratio learning process is executed after the purge learning process is completed by the controller 100. At the time point when the P/L learning process is resumed, the learning of the energizing time correction value TdiC by the P/L learning process is advanced to a certain extent. Thus, even if the air-fuel ratio learning process is performed parallel to the P/L learning process, the update accuracy of the air-fuel ratio learning value KG by the air-fuel ratio learning process is less likely to lower. Furthermore, the air-fuel ratio learning process can be completed early compared to when performing the air-fuel ratio learning process after the P/L learning process is completed.

Therefore, in the present embodiment, each learning process can be completed early by efficiently performing each learning process.

In the example shown in FIG. 10, the P/L learning process is completed at timing t13. Thus, after timing t13, the diagnosis process is performed. When it is determined that the P/L injection by the in-cylinder injection valve 23 is normally performed at timing t14, the diagnosis process is completed, and the specified load region RKL is not set.

In the present embodiment, effects described below can be further obtained in addition to the advantageous effects described above.

(1) When the temperature of the nozzle body 57, that is, the distal end temperature estimated value TmpDI is high, the lower limit RKLll of the specified load region RKL becomes greater than when the temperature of the nozzle body 57 is low, and thus the P/L injection of small fuel injection amount is less likely to be performed. Thus, a deposit can be refrained from easily accumulating at the periphery of the injection hole 571 in the nozzle body 57.

When the temperature of the nozzle body 57 is low, the lower limit RKLll decreases, and thus the P/L injection is easily performed. Therefore, when a state in which the temperature of the nozzle body 57 is low is continued over a long period, the P/L injection is performed at a relatively high frequency, thus contributing to early completion of the P/L learning process.

(2) When the correction ratio δ calculated by the feedback control of the air-fuel ratio is a negative value, the requested injection amount Qrdpl for the P/L injection tends to reduce, and thus the lower limit RKLll of the specified load region RKL is made greater as the absolute value of the correction ratio δ increases. In other words, the P/L injection of small fuel injection amount is less likely to be performed. As a result, the variation in the actual fuel injection amount when the P/L injection is performed by the in-cylinder injection valve 23 is suppressed, and thus the lowering of the learning accuracy of the energizing time correction value TdiC by the P/L learning process can be suppressed.

(3) The lower limit RKLll of the specified load region RKL when resuming the P/L learning process is set to a value greater than the lower limit RKLll before interrupting the P/L learning process. Thus, immediately after resuming the P/L learning process, the P/L injection of small fuel injection amount is less likely to be performed, that is, variation in the fuel injection amount in the in-cylinder injection valve 23 is less likely to occur. Therefore, the update accuracy of the air-fuel ratio learning value KG by the air-fuel ratio learning process performed in parallel with the P/L learning process can be refrained from lowering.

(4) Furthermore, in the air-fuel ratio learning process, when the P/L learning process is not completed, the updating speed of the air-fuel ratio learning value KG is smaller than when the P/L learning process is completed. The divergence of the requested injection amount Qrdpl for the P/L injection and the actual injection amount of the in-cylinder injection valve 23 is more likely to become large before the P/L learning process is completed than after the P/L learning process is completed. Thus, the lowering of the update accuracy of the air-fuel ratio learning value KG can be suppressed by changing the updating speed of the air-fuel ratio learning value KG depending on whether or not the P/L learning process is completed.

(5) As described above, the learning accuracy of the energizing time correction value TdiC by the P/L learning process becomes higher as the P/L injection execution number X by the in-cylinder injection valve 23 becomes greater. In other words, the divergence of the requested injection amount Qrdpl for the P/L injection and the actual injection amount of the in-cylinder injection valve 23 decreases. The updating accuracy of the air-fuel ratio learning value KG by the air-fuel ratio learning process becomes higher as the divergence is smaller. Thus, in the present embodiment, the lower limit RKLll of the specified load region RKL decreases as the P/L injection execution number X increases, after the purge learning process is completed. In other words, when determination can be made that the updating accuracy of the air-fuel ratio learning value KG by the air-fuel ratio learning process is high, the execution frequency of the P/L injection becomes high, thus contributing to the early completion of the P/L learning process.

(6) Furthermore, in the present embodiment, the upper limit RKLul of the specified load region RKL becomes greater as the P/L injection execution number X by the in-cylinder injection valve 23 increases, after the purge learning process is completed. Thus, the execution frequency of the P/L injection can be further increased. This can contribute to the early completion of the P/L learning process.

Moreover, the P/L injection of relatively large fuel injection amount can be easily performed by the in-cylinder injection valve 23 by increasing the upper limit RKLul of the specified load region RKL. The variation in the fuel injection amount of the in-cylinder injection valve 23 is less likely to occur as the requested injection amount Qrdpl for the P/L injection increases. Thus, the learning accuracy of the energizing time correction value TdiC by the P/L learning process can be increased by increasing the execution frequency of the P/L injection in which variation in fuel injection amount is less likely to occur.

(7) The energizing time of the electromagnetic coil 53 of the in-cylinder injection valve 23 during the F/L injection is longer than the energizing time of the electromagnetic coil 53 during the P/L injection. The remaining magnetism of the electromagnetic coil 53 after the current flow is terminated is more likely to become larger as the energizing time of the electromagnetic coil 53 is longer. Such remaining magnetism is gradually reduced with elapse of time. Furthermore, when the next fuel injection, that is, the next current flow to the electromagnetic coil 53 is started with large remaining magnetism, the controllability of the in-cylinder injection valve 23 tends to lower by the influence of the remaining magnetism. Thus, if the P/L injection is performed after the F/L injection when dividing the fuel injection of the in-cylinder injection valve 23 to a plurality of times, the time from the termination of the F/L injection to the start of the P/L injection is short and the remaining magnetism of the electromagnetic coil 53 is large, and thus the fuel injection amount by the P/L injection tends to easily vary. As a result, the learning accuracy of the energizing time correction value TdiC by the P/L learning process easily lowers.

In this respect, in the present embodiment, when dividing the fuel injection of the in-cylinder injection valve 23 to a plurality of times including the F/L injection and the P/L injection, the P/L injection is performed before the F/L injection. Thus, the in-cylinder injection valve 23 can be caused to perform the P/L injection hardly without being subjected to the influence of the remaining magnetism of the electromagnetic coil 53. As a result, the lowering of the learning accuracy of the energizing time correction value TdiC by the P/L learning process can be suppressed.

(8) Even in a state the P/L learning process is completed, the divergence of the requested injection amount Qrdpl for the P/L injection and the actual injection amount during the P/L injection by the in-cylinder injection valve 23 tends to become greater than the divergence of the requested injection amount Qrdfl for the F/L injection and the actual injection amount during the F/L injection by the in-cylinder injection valve 23. Thus, the specified load region RKL becomes narrower as the P/L injection execution number X by the in-cylinder injection valve 23 increases, after the P/L learning process is completed. In other words, the execution frequency of the P/L injection in which the divergence more easily occurs than the F/L injection can be gradually lowered as the execution number X increases. Thus, the lowering of the update accuracy of the air-fuel ratio learning value KG can be suppressed by lowering the execution frequency of the P/L injection.

It should be apparent to those skilled in the art that the present invention may be embodied in many other specific forms without departing from the spirit or scope of the invention. Particularly, it should be understood that the present invention may be embodied in the following forms.

If the lowering of the controllability of the P/L injection caused by the remaining magnetism of the electromagnetic coil 53 generated by the F/L injection is within a tolerable range even if the in-cylinder injection valve 23 is caused to perform the F/L injection and then caused to perform the P/L injection, the in-cylinder injection valve 23 may be caused to perform the P/L injection after the F/L injection when dividing the fuel injection of the in-cylinder injection valve 23 to a plurality of times.

After the P/L learning process is completed, if the specified load region RKL can be made narrower as the P/L injection execution number X by the in-cylinder injection valve 23 increases, while the upper limit RKLul may be gradually reduced as the execution number X increases, the lower limit RKLll may not be increased. Furthermore, after the P/L learning process is completed, while the lower limit RKLll may be gradually increased as the P/L injection execution number X increases, the upper limit RKLul may not be reduced.

After the P/L learning process is completed, both the upper limit RKLul and the lower limit RKLll of the specified load region RKL may be held until the diagnosis process is completed. In this case, the diagnosis process can be completed early because the execution frequency of the P/L injection is not reduced compared to when narrowing the specified load region RKL as the execution number X increases as in the embodiment described above.

After the P/L learning process is completed, the updating speed of the air-fuel ratio learning value KG after the diagnosis process is completed may be made greater than the updating speed of the air-fuel ratio learning value KG of before the diagnosis process is completed.

In the embodiment described above, the change in the updating speed of the air-fuel ratio learning value KG is realized by changing the update value ΔKG. However, this is not the sole case, and the update value ΔKG may not be changed if the updating speed of the air-fuel ratio learning value KG can be changed. For example, the updating speed of the air-fuel ratio learning value KG may be changed by changing a control cycle for updating the air-fuel ratio learning value KG.

In the embodiment described above, the updating speed of the air-fuel ratio learning value KG is varied depending on whether or not the P/L learning process is completed. However, this is not the sole case, and for example, the updating speed of the air-fuel ratio learning value KG may be gradually increased as the P/L injection execution number X is increased.

In the air-fuel ratio learning process, the updating speed of the air-fuel ratio learning value KG may not be changed depending on whether or not the P/L learning process is completed.

After the purge learning process is completed, the upper limit RKLul of the specified load region RKL may not be varied according to the execution number X.

After the purge learning process is completed, the lower limit RKLll of the specified load region RKL may not be varied according to the execution number X.

After the purge learning process is completed, the lower limit RKLll of the specified load region RKL when resuming the P/L learning process may not be made greater than the lower limit RKLll before interrupting the P/L learning process if the lowering of the update accuracy of the air-fuel ratio learning value KG caused by the resuming of the P/L learning process can be suppressed within a tolerable range.

In the embodiment described above, while the lower limit RKLll of the specified load region RKL is corrected based on the correction ratio δ when the correction ratio δ is a negative value, the lower limit RKLll is not corrected when the correction ratio δ is a value greater than or equal to "0". However, if the lower limit RKLll is corrected based on the correction ratio δ when the correction ratio δ is a negative value, the lower limit RKLll may be corrected based on the correction ratio δ even when the correction ratio δ is a positive value. In this case, when the correction ratio δ is a positive value, the lower limit RKLll may be corrected so that the lower limit RKLll decreases as the correction ratio δ increases. In this case, when the correction ratio δ is a positive value, the execution opportunity of the P/L injection by the in-cylinder injection valve 23 is increased, which contributes to early completion of the P/L learning process.

The process of correcting the lower limit RKLll of the specified load region RKL based on the correction ratio δ may be omitted.

If a sensor that detects the temperature of the distal end portion of the in-cylinder injection valve 23 is provided, the lower limit RKLll of the specified load region RKL may be corrected based on the temperature detected by the sensor.

When it can be confirmed that deposit is less likely to accumulate at the nozzle body 57 even if the in-cylinder injection valve 23 is caused to perform the P/L injection of relatively small fuel injection amount, the correction of the lower limit RKLll of the specified load region RKL based on the temperature of the distal end portion of the in-cylinder injection valve 23 may be omitted.

In the embodiment described above, when the P/L learning process is interrupted, the purge learning process and the air-fuel ratio learning process are started at substantially the same time. However, if the purge learning process and the air-fuel ratio learning process are to be started provided that the P/L learning is interrupted, the start timing of the purge learning process and the start timing of the air-fuel ratio learning process may be shifted.

In the embodiment described above, the P/L learning process is resumed immediately after the purge learning process is completed. However, if the P/L learning process is to be resumed provided that the purge learning process is completed, the P/L learning process may not be resumed immediately after the completion of the purge learning process. For example, the P/L learning process may be resumed after elapse of a specified time from the time point when the purge learning process is completed. Furthermore, after the purge learning process is completed, the P/L learning process may be resumed from the time point when determination is made that the learning of the air-fuel ratio learning value KG has advanced to a certain extent.

The injection characteristic of the in-cylinder injection valve 23 learned by the P/L learning process may be other parameters other than the energizing time correction value TdiC as long as it can be used when causing the in-cylinder injection valve 23 to perform the P/L injection.

In the embodiment described above, the advancement degree of the learning of the injection characteristic of the in-cylinder injection valve 23 by the P/L learning process is presumed with the P/L injection execution number X by the in-cylinder injection valve 23. However, as long as the advancement degree of the learning of the injection characteristic can be presumed, other parameters other than the execution number X may be used to determine the interrupting timing of the P/L learning process. For example, other parameters other than the execution number X include a total time of a state in which the engine operation is performed in the specified load region RKL. In this case, when the total time of such state from the engine start reaches the specified time, the P/L learning process is interrupted.

Furthermore, the P/L learning process performed under a situation that the purge learning process is not yet started may be interrupted when the valve closing time difference ΔCT, which is the difference of the predicted valve closing time CTe and the valve closing time CTs, is not greater than or equal to a predetermined interruption determination value. The interruption determination value is set to a value greater than the difference determination value ΔCTTh.

The internal combustion engine to which the controller 100 is applied may not include the passage injection valve 22 as long as it includes the in-cylinder injection valve 23.

The controller 100 is not limited to one that includes a central processing unit and a memory, and performs all the various types of processes described above by software. For example, the controller 100 may include dedicated hardware (Application Specific Integrated Circuit: ASIC) that executes at least some processes. That is, the controller 100 may be a circuit including 1) one or more dedicated hardware circuits such as ASIC, 2) one or more processors (microcomputers) that operate according to a computer program (software), or 3) combination thereof.

The present examples and embodiments are to be considered as illustrative and not restrictive, and the invention is not to be limited to the details given herein, but may be modified within the scope and equivalence of the appended claims.

The invention claimed is:

1. An internal combustion engine controller applied to an internal combustion engine including an in-cylinder injection valve that injects fuel into a cylinder, the internal combustion engine controller comprising:

an injection control unit that controls driving of the in-cylinder injection valve based on a requested injection amount of the in-cylinder injection valve;

a partial lift learning unit that, when a partial lift injection that terminates fuel injection before a valve body reaches a fully open position is performed in the in-cylinder injection valve, performs a partial lift learning process of learning an injection characteristic of the in-cylinder injection valve so that a divergence of a correlation value of the requested injection amount and a correlation value of an actual injection amount is decreased based on a present correlation value of the requested injection amount of the in-cylinder injection valve and the correlation value of the actual injection amount of the in-cylinder injection valve when the partial lift injection is performed, wherein the partial lift learning unit completes the partial lift learning process when the divergence is smaller than a specified value;

a purge learning unit that performs a purge learning process of learning a concentration of a fuel vapor purged to an intake passage when purging of the fuel vapor collected by a canister to the intake passage is permitted;

an air-fuel ratio feedback unit that updates a correction ratio of an air-fuel ratio to reduce a deviation of an air-fuel ratio detection value, which is a detection value of the air-fuel ratio of a mixture burned in the internal combustion engine, and a target air-fuel ratio, which is a target value of the air-fuel ratio;

an air-fuel ratio learning unit that performs an air-fuel ratio learning process of updating a learning value of the air-fuel ratio so that the correction ratio approaches "0"; and a storage unit that stores a learning result of each of the partial lift learning process, the purge learning process, and the air-fuel ratio learning process, wherein when the learning result of each of the partial lift learning process, the purge learning process, and the air-fuel ratio learning process is not stored in the storage unit at a time of engine start, the partial lift learning unit is configured to learn the injection characteristic of the in-cylinder injection valve through the partial lift learning process whenever the in-cylinder injection valve performs the partial lift injection under a situation in which purging of the fuel vapor to the intake passage is stopped, interrupt the partial lift learning process before the partial lift learning process is completed, and then resume the partial lift learning process provided that the purge learning process has been completed;

when the learning result of each of the partial lift learning process, the purge learning process, and the air-fuel ratio learning process is not stored in the storage unit at the time of engine start, the purge learning unit is configured to permit purging of the fuel vapor to the intake passage provided that the partial lift learning process is interrupted and then perform the purge learning process; and when the learning result of each of the partial lift learning process, the purge learning process, and the air-fuel ratio learning process is not stored in the storage unit at the time of engine start, the air-fuel ratio learning unit is configured to start the air-fuel ratio learning process provided that the partial lift learning process has been interrupted.

2. The internal combustion engine controller according to claim 1, wherein when the purging of the fuel vapor to the intake passage is stopped and then the partial lift learning process is performed, the partial lift learning unit is configured to interrupt the partial lift learning process provided that the partial lift injection has been executed a specified number of times.

3. The internal combustion engine controller according to claim 1, wherein the injection control unit is configured to divide a fuel injection of the in-cylinder injection valve into a plurality of times including the partial lift injection provided that an engine operation is being performed in a specified load region; and the internal combustion engine controller further comprises a load region setting unit configured to set a lower limit of the specified load region that increases as a temperature of a distal end portion of the in-cylinder injection valve increases before the purge learning process is completed.

4. The internal combustion engine controller according to claim 3, further comprising a requested injection amount calculating unit, wherein when the fuel injection of the in-cylinder injection valve is divided into a plurality of times, the requested injection amount calculating unit is configured to calculate a requested injection amount of each divided fuel injection based on a basic injection amount, which is a calculation value of a fuel injection amount based on an engine load rate and the correction ratio calculated by the air-fuel ratio feedback unit, wherein the requested injection amount calculating unit is configured to calculate the requested injection amount of each fuel injection so that when the correction ratio is a negative value, the requested injection amount of each fuel injection decreases as an absolute value of the correction ratio increases;

the injection control unit is configured to control the driving of the in-cylinder injection valve based on a calculation result by the requested injection amount calculating unit; and the load region setting unit is configured to increase the lower limit of the specified load region as the absolute value of the correction ratio increases when the correction ratio is the negative value.

5. The internal combustion engine controller according to claim 3, wherein the load region setting unit is configured to increase the lower limit of the specified load region when resuming the partial lift learning process from the lower limit before interrupting the partial lift learning process.

6. The internal combustion engine controller according to claim 5, wherein the load region setting unit is configured to decrease the lower limit of the specified load region as the number of times the partial lift injection is executed increases after the purge learning process is completed.

7. The internal combustion engine controller according to claim 5, wherein the load region setting unit is configured to increase an upper limit of the specified load region as the number of times the partial lift injection is executed increases after the purge learning process is completed.

8. The internal combustion engine controller according to claim 3, wherein the air-fuel ratio learning unit is configured to update a learning value of the air-fuel ratio so that the learning value gradually changes in the air-fuel ratio learning process, and the air-fuel ratio learning unit is configured to reduce an updating speed of the learning value of the air-fuel ratio when the partial lift learning process is not completed from that when the partial lift learning process is completed in the air-fuel ratio learning process.

9. The internal combustion engine controller according to claim 3, further comprising a partial lift diagnosis unit configured to perform a diagnosis process of determining whether or not the partial lift injection is normally performed provided that the partial lift learning process is completed, wherein the load region setting unit is configured to narrow the specified load region as the number of times the partial lift injection is executed increases when the diagnosis process is being performed.

10. The internal combustion engine controller according to claim 1, wherein when dividing a fuel injection of the in-cylinder injection valve into a plurality of times to include both a full lift injection for terminating the fuel injection after the valve body reaches a fully open position and the partial lift injection, the injection control unit is configured to have the in-cylinder injection valve perform the partial lift injection and then perform the full lift injection.

11. A learning method of a learning value applied to an internal combustion engine including an in-cylinder injection valve that injects fuel into a cylinder, wherein the in-cylinder injection valve is configured to perform a partial lift injection that terminates fuel injection before a valve body reaches a fully open position, the learning method comprising:

updating a correction ratio of an air-fuel ratio to reduce a deviation of an air-fuel ratio detection value, which is a detection value of an air-fuel ratio of a mixture burned in the internal combustion engine, and a target air-fuel ratio, which is a target value of the air-fuel ratio;

performing a partial lift learning process of learning an injection characteristic of the in-cylinder injection valve when the in-cylinder injection valve performs the partial lift injection;

performing a purge learning process of learning a concentration of fuel vapor purged to an intake passage when purging of the fuel vapor collected by a canister to the intake passage is permitted;

performing an air-fuel ratio learning process of updating a learning value of the air-fuel ratio so that the correction ratio approaches "0"; and storing a learning result of each of the partial lift learning process, the purge learning process, and the air-fuel ratio learning process in a storage unit of a controller, wherein in the partial lift learning process, the injection characteristic of the in-cylinder injection valve is learned so that a divergence of a correlation value of a requested injection amount and a correlation value of an actual injection amount is decreased based on the correlation value of the requested injection amount of the in-cylinder injection valve when the partial lift injection is performed and the correlation value of the actual injection amount of the in-cylinder injection valve when the partial lift injection is performed;

the partial lift learning process is completed when the divergence is less than a specified determined value;

when the learning result of each of the partial lift learning process, the purge learning process, and the air-fuel ratio learning process is not stored in the storage unit at time of engine start, the learning method further stops purging the fuel vapor to the intake passage and then performs the partial lift injection and learns the injection characteristic of the in-cylinder injection valve through the partial lift learning process whenever the partial lift injection is performed, interrupts the partial lift learning process before the partial lift learning process is completed and then permits purging of the fuel vapor to the intake passage and performs the purge learning process while starting the air-fuel ratio learning process, and resumes the partial lift learning process while continuing the air-fuel ratio learning process after the purge learning process is completed.

12. An internal combustion engine controller applied to an internal combustion engine including an in-cylinder injection valve that injects fuel into a cylinder, the internal combustion engine controller comprising circuitry configured to:

control driving of the in-cylinder injection valve based on a requested injection amount of the in-cylinder injection valve;

when a partial lift injection that terminates fuel injection before a valve body reaches a fully open position is performed in the in-cylinder injection valve, perform a partial lift learning process of learning an injection characteristic of the in-cylinder injection valve so that a divergence of a correlation value of the requested injection amount and a correlation value of an actual injection amount is decreased based on a present correlation value of the requested injection amount of the in-cylinder injection valve and the correlation value of the actual injection amount of the in-cylinder injection valve when the partial lift injection is performed, wherein the internal combustion engine controller completes the partial lift learning process when the divergence is smaller than a specified value;

perform a purge learning process of learning a concentration of a fuel vapor purged to an intake passage when purging of the fuel vapor collected by a canister to the intake passage is permitted;

update a correction ratio of an air-fuel ratio to reduce a deviation of an air-fuel ratio detection value, which is a detection value of the air-fuel ratio of a mixture burned in the internal combustion engine, and a target air-fuel ratio, which is a target value of the air-fuel ratio;

perform an air-fuel ratio learning process of updating a learning value of the air-fuel ratio so that the correction ratio approaches "0"; and store a learning result of each of the partial lift learning process, the purge learning process, and the air-fuel ratio learning process in a storage, wherein the internal combustion engine controller is further configured to:

when the learning result of each of the partial lift learning process, the purge learning process, and the air-fuel ratio learning process is not stored in the storage at a time of engine start, learn the injection characteristic of the in-cylinder injection valve through the partial lift learning process whenever the in-cylinder injection valve performs the partial lift injection under a situation in which purging of the fuel vapor to the intake passage is stopped, interrupt the partial lift learning process before the partial lift learning process is completed, and then resume the partial lift learning process provided that the purge learning process has been completed;

when the learning result of each of the partial lift learning process, the purge learning process, and the air-fuel ratio learning process is not stored in the storage at the time of engine start, permit purging of the fuel vapor to the intake passage provided that the partial lift learning process is interrupted and then performing the purge learning process; and when the learning result of each of the partial lift learning process, the purge learning process, and the air-fuel ratio learning process is not stored in the storage at the time of engine start, start the air-fuel ratio learning process provided that the partial lift learning process has been interrupted.

* * * * *